US011364703B2

(12) United States Patent
Adami

(10) Patent No.: US 11,364,703 B2
(45) Date of Patent: Jun. 21, 2022

(54) PLANT COMPRISING A SINGLE FACER, AND METHOD

(71) Applicant: FOSBER S.P.A., Pescaglia (IT)

(72) Inventor: Mauro Adami, Viareggio (IT)

(73) Assignee: Fosber S.p.A., Lucca (IT)

( * ) Notice: Subject to any disclaimer, the term of this patent is extended or adjusted under 35 U.S.C. 154(b) by 67 days.

(21) Appl. No.: 16/802,148

(22) Filed: Feb. 26, 2020

(65) Prior Publication Data

US 2020/0307142 A1 Oct. 1, 2020

(30) Foreign Application Priority Data

Mar. 28, 2019 (IT) ..... 102019000004661

(51) Int. Cl.
*B31F 1/28* (2006.01)

(52) U.S. Cl.
CPC ..... *B31F 1/2877* (2013.01); *B31F 1/2863* (2013.01); *B31F 1/2868* (2013.01)

(58) Field of Classification Search
CPC ..... B31F 1/2868; B21B 31/106
See application file for complete search history.

(56) References Cited

U.S. PATENT DOCUMENTS 5,150,514 A * 9/1992 Seki ..... B21B 31/08 29/824
6,238,198 B1 * 5/2001 Hatasa ..... B31F 1/2868 425/DIG. 235
8,210,013 B2 * 7/2012 Rossigneux ..... B21B 31/103 72/239
8,714,223 B2 5/2014 Adami et al.

FOREIGN PATENT DOCUMENTS

DE 202007004668 U1 6/2007
EP 1362691 A2 11/2003
EP 1775115 A1 4/2007
WO 2009107439 A1 9/2009

* cited by examiner

*Primary Examiner* — Barbara J Musser
(74) *Attorney, Agent, or Firm* — Breiner & Breiner, L.L.C.

(57) ABSTRACT

The plant includes at least one single facer, having a supporting structure, adapted to receive a corrugating unit provided with a first corrugating roller and a second corrugating roller meshing with each other. The plant also includes a magazine having a plurality of seats for receiving corrugating units and movable along a first guide. Associated with the single facer there is provided a shuttle movable between the single facer and the guide of the magazine, adapted to transfer corrugating units from the single facer to the magazine and vice versa.

22 Claims, 21 Drawing Sheets

PLANT COMPRISING A SINGLE FACER, AND METHOD

TECHNICAL FIELD

The present invention relates to plants for producing corrugated board. More particular, the invention relates to the part known as "wet end" of a line for producing corrugated board, comprising one or more single facers.

BACKGROUND ART

To produce corrugated board, lines are used, to which endless webs of paper are fed. Some of these webs are subjected to a process that produces therein flutes orthogonal to the direction of feed. Alternate smooth and corrugated paper webs are superimposed and glued to one another to form a corrugated board. Each corrugated board comprises at least one web of smooth paper and one web of corrugated paper. The corrugated board web can then be creased and cut into single sheets.

To corrugate the paper webs, machines called "single facers" are used. Each single facer comprises a pair of corrugating rollers meshing with each other and defining a corrugating nip. The web of paper to be corrugated is fed through the nip formed by the two corrugating rollers meshing with each other and suitably heated. As a result of the thermal and mechanical action exerted by the corrugating rollers, the web of paper is permanently deformed, forming a plurality of flutes arranged parallel to each other and one after the other in the direction of feed of the web material. At the outlet of the single facer the web of corrugated paper is hot glued using pressure to a web of smooth paper, also known as "liner".

Examples of single facers of the current art are disclosed in U.S. Pat. No. 8,714,223, EP1362691, which can be referred to for further details.

Usually, a corrugated board production line is provided with two or more single facers to produce single- or multiple-fluted corrugated board, according to requirements of each production order.

The shape and the dimension of the flutes of the corrugated board can vary according to the job order. Frequently, the orders are relatively small, the production of a limited amount of corrugated board is required for each order. It is thus necessary to replace the corrugating rollers, even with a certain frequency, to produce corrugated board with the characteristics required for each single order.

In order to simplify replacement of the corrugating rollers, the provision of so-called cartridges, hereinafter indicated as "corrugating units", is known, each comprising a pair of corrugating rollers mounted on heads integral with each other; the corrugating rollers of one corrugating unit mesh with each other and are already mounted on a containing and supporting structure. This enables them to be replaced rapidly.

Plants for moving and replacing corrugating units in a single facer have also been produced. WO-A-2009107439 discloses a motorized carriage guided by an operator, for moving and transferring corrugating units in a plant.

EP1775115 discloses a single facer provided with a lateral magazine. Two corrugating units can be arranged in the lateral magazine, usable alternatively to each other in a single facer that the magazine is placed next to. Translation guides are provided to replace a corrugating unit in use with a corrugating unit standing by in the magazine. The magazine comprises two seats for corrugating units, each of which is provided with a pair of guides. These are selectively aligned with a pair of guides integral with the single facer. A translation mechanism, comprising a motor fixed with respect to the single facer that controls a rack and pinion transmission, translates the single corrugating units along the guides. To translate a corrugating unit from the single facer to the magazine and vice versa, the corresponding guides of the magazine are aligned with the guides integral with the single facer to form a continuous guide system.

This known mechanism is not particularly flexible and has some problems. In particular, the moving mechanism makes it necessary to place the magazine very close, to the single facer. Moreover, the corrugating units are transferred by running on guides that are located partly on the magazine and partly in the single facer. Once the corrugating unit has been inserted into the single facer, it must be lifted from the guides and held in an operating position at a greater height than the height of the guides. As the corrugating units are very heavy, and a vertical thrust oriented downward is also applied thereto to glue the web of corrugated paper to a web of smooth paper, actuators capable of generating very high thrusts, typically hydraulic piston-cylinder actuators, are required to maintain the corrugating unit in the correct operating position. Accidental decrease of the pressure of the fluid in the cylinder of the actuator causes emergency shutdown of the single facer.

DE 202007004668 discloses a plant comprising a single facer having a supporting structure adapted to receive a corrugating unit. The corrugating unit comprises a first corrugating roller and a second corrugating roller meshing with each other. The plant further comprises a magazine including a plurality of seats for receiving corrugating units and movable along a guide. Each corrugating unit has wheels and can be moved from the single facer to the magazine and vice-versa. The magazine rains along the single face at a distance therefrom such that each corrugating unit can be transferred from the single facer directly into the magazine and vice-versa using the wheels, each corrugating unit is provided with. A cumbersome retention device is required to lock the corrugating unit in the single facer, preventing the corrugating unit from moving with respect to the single facer when in use.

Therefore, there is a need for a plant with simpler and more and efficient management and replacement of the corrugating units.

SUMMARY

According to one aspect, a plant for producing corrugated board is provided, comprising at least one single facer, having a supporting structure adapted to receive a corrugating unit with a first corrugating roller and a second corrugating roller meshing with each other. The plant also comprises a magazine with a plurality of receiving seats for receiving corrugating units. The magazine is movable along a first guide, preferably in a direction orthogonal to the axes or the corrugating rollers, when the corrugating rollers are located in the single facer. Associated with the single facer is a moving shuttle, adapted to move between the single facer and the guide of the magazine and to transfer corrugating units from the single facer to the magazine and vice versa. The movement of the shuttle is preferably orthogonal to the movement of the magazine.

Differently from some plants of the current art, therefore, the single facer is provided with its own shuttle, which moves back and forth from the single facer to the magazine and vice-versa, to transfer corrugating units from the single facer to the magazine and vice versa. The shuttle can pick up a corrugating unit from the single facer, transfer the corrugating unit from the single facer to the magazine and release the corrugating unit in a free one of the seats of the magazine. The same shuttle can pick up one of the corrugating units from the magazine, transfer the corrugating unit from the magazine to the single facer and release the corrugating unit in the single facer.

The corrugating units do not need to be provided with their own wheels and motors, for moving back and forth from the single facer to the magazine and vice-versa. Moreover, safer and easier locking of the corrugating unit in the single facer can be obtained in a simple and reliable manner.

In this way, it is possible to obtain a highly flexible management of the corrugating units.

In particularly advantageous embodiments, the shuttle comprises lifting members, adapted to lift the corrugating units from the supporting structure of the single facer and from the magazine and to lower the corrugating units onto the supporting structure of the single facer and onto the magazine. Therefore, when the corrugating unit is in the operating position in the single facer, it is positioned at a lower height than the height at which it is positioned when it is on the shuttle. This avoids the need for complex actuators that push the corrugating unit upward when it is operating in the single facer. Besides representing a simplification from a mechanical point of view, this makes the plant safer and more reliable, and also less subject to stoppages.

Advantageously, the shuttle is preferably movable along a second guide extending between the single facer and the first guide. The guide of the magazine and the guide of the shuttle can be arranged substantially orthogonal to each other and can be substantially about on the same plane and intersecting with each other, in this way it is possible to reduce the excavation works required to install the guides and at the same time reduce their footprint above the floor. This makes implementation of the plant less costly and reduces the presence of obstacles that may negatively affect the passage or transit of vehicles, materials and people in the plant.

In advantageous embodiments, the plant can comprise a plurality of single facers arranged in sequence along a direction of alignment parallel to the first guide. Each single facer can comprise a respective shuttle movable between the single facer and the first guide, adapted to transfer corrugating units from the respective single facer to the magazine and vice versa. The magazine can be adapted to be positioned selectively in alignment with one or other of the single facers, to transfer, by means of the respective shuffle, corrugating units from the magazine to the respective single facer and vice versa.

According to another aspect, a method for inserting a corrugating unit into a single facer is disclosed, the corrugating unit comprising a first corrugating roller and a second corrugating roller meshing with each other, the method comprising the steps of:

positioning a magazine comprising a plurality of seats for corrugating units, so that one of said seats is aligned with the single facer;

with a shuttle movable from the single facer to the magazine and vice versa:

picking up a corrugating unit positioned in said seat aligned with the single facer and transferring said corrugating unit into the single facer; or picking up a corrugating unit positioned in the single facer and transferring said corrugating unit into the magazine.

According to yet another aspect, a plant for producing corrugated board is described, comprising a plurality of single facers, each comprising a supporting structure adapted to receive a corrugating unit having a first corrugating roller and a second corrugating roller, meshing with each other. The single facers are aligned according to a direction of alignment. The plant further comprises a magazine having a plurality of seats for receiving corrugating units and movable along a guide. The guide extends parallel to the direction of alignment of the single facers and has a length such that the magazine can transfer corrugating units to one or to the other of each of said single facers. According to embodiments, the transfer of the corrugating units from the magazine to one or to the other of the single facers, and vice versa, can take place with a shuttle system of the type defined above, or with other systems and mechanisms, for example those described in the prior art mentioned in the introduction of the present description. In this case, with respect to the state of the art, the plant is characterized in particular by the fact that the magazine is also used to transfer corrugating units from one to the other of a plurality of single facers placed in sequence. The magazine can thus serve a plurality of single facers and allow corrugating units to be exchanged and shared between a plurality of single facers of the same plant.

Further advantageous embodiments and possible features of the plant and of the method disclosed herein are illustrated below with reference to the accompanying drawings.

BRIEF DESCRIPTION OF THE DRAWINGS

The invention will be better understood by following the description and the accompanying drawings, which illustrate an exemplifying and non-limiting embodiment of the invention. More particularly, in the drawings.

DETAILED DESCRIPTION

Figure 1:
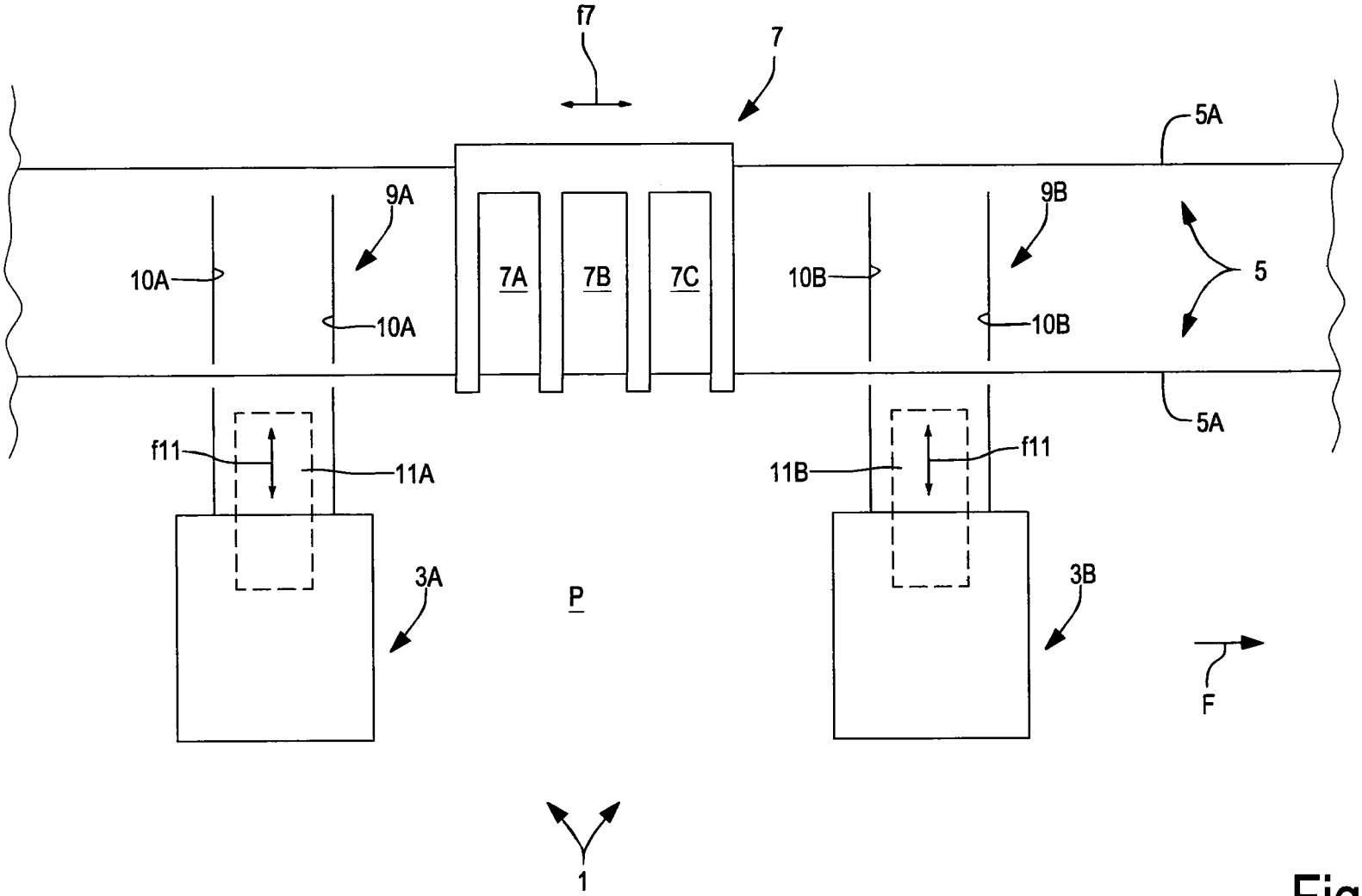
FIG. 1 shows a plan diagram of a line with two single facers and a magazine.

FIG. 1 shows a plan view of a plant 1 for producing corrugated board, wherein only the elements of the plant useful for a better understanding of the present invention are represented schematically. In the example illustrated in FIG. 1, the plant 1 comprises two single facers 3A, 3B, aligned along a direction F that represents the general direction of feed of the webs of paper through the plant. One of these single facers, indicated generically hereinafter with 3, will be described in greater detail below with reference to the subsequent figures. While FIG. 1 shows two single facers 3A, 3B, it must be understood that the number of single facers of a line or plant for producing corrugated board can vary. In some cases, even only one single facer may be provided, although preferably two or more single facers will be provided in sequence, which can either all be operating or can be activated selectively depending upon the type of corrugated board to be produced.

On one side of the sequentially arranged single facers 3 a first guide 5 is positioned, for example comprising two rails 5A, on which a magazine 7 is movable. The reference f7 indicates the direction of movement of the magazine 7 along the guide 5.

As will clarified below, the magazine 7 is provided with several seats 7A, 7B, 7C for receiving corrugating units, each of which comprises a pair of corrugating rollers meshing with each other. The corrugating units can be inserted selectively into one or into the other of the single facers 3A, 3B. In the embodiment illustrated, the magazine 7 comprises three seats for three corrugating units. Moreover, it must be understood that the number of seats of the magazine 7 can differ from the number illustrated by way of example.

The magazine 7 can be used both to load one or the other of several corrugating units onto just one single facer 3A, 3B, and also to transfer corrugating units from one to the other of the various single facers of the line.

To transfer the corrugating units (not shown in FIG. 1) from the magazine 7 to one or to the other of the single facers 3A, 3B, and vice versa, each single facer 3A, 3B comprises a respective second guide 9A, 9B, which can be formed of a pair of rails 10A, 10B. A shuttle 11A, 11B is movable on each second guide 9A, 9B. The reference f11 indicates the direction of movement of each shuffle. The shuttles 11A, 11B can be the same as one another and one of them, indicated with 11, will be described in greater detail below with reference to the remaining figures.

Advantageously, the guides 5, 9A, 9B are mounted approximately at the level of the floor P on which the single facers 3A, 3B are installed, so as to limit to a minimum the excavation works and encumbrances above the floor P. More in particular, the rails 10A, 10B of the guides 9A. 9B can be fixed directly on the floor, while the rails 5A of the guide 5 can be anchored to a structure embedded in the floor P. The rails 10A, 10B can be interrupted at the rail 5A with which they intersect.

In this way, for example, conveyors can be easily arranged for transferring the reels of paper into and out of the production line in which the unwinders are inserted, without encountering obstacles.

Each shuttle 11A, 11B can be selectively inserted into the respective single facer 3A, 3B, or into the magazine 7, so as to be able to position a corrugating unit in the single facer 3A, 3B or in the magazine 7. To allow the shuttle 11A, 11B to be positioned in alignment with the magazine 7, i.e., inside or underneath it, the rails 10A, 10B of the second guide 9A, 9B can be interrupted in the point of intersection with one of the rails 5A of the first guide 5.

In the example of FIG. 1 the magazine 7 is movable with respect to the single facers 3A, 3B so as to allow alignment of one or other of the seats of the magazine with one or other of said single facers 3A, 3B. In this way, it is possible to transfer corrugating units from any one of the single facers 3A, 3B to the magazine 7 and vice versa. The magazine 7 therefore allow sharing of a plurality of corrugating units with only one single facer 3A, or 3B, or alternatively with both single facers 3A, 3B, and with other single facers, not shown, if present in the production line.

The use of a magazine 7 movable between a plurality of aligned single facers is particularly useful and advantageous, in particular as it allows the use of a single member to transfer corrugating units from one to the other of several single facers. It is also possible to increase the capacity of the magazine, providing it with a number of seats higher than the three seats represented schematically in FIG. 1.

Moreover, it would also be possible for the plant to have only one single facer served by a magazine, or for the plant to have several single facers and several magazines. For example, it is possible to provide a guide 5 on which two or more magazines, capable of interfacing with only one single facer or, preferably, with a series of single facers, are movable.

In some embodiments, the guide 5 of the magazine 7 can also extend beyond the single facers, for example toward a standby area, where corrugating units can be loaded onto or unloaded from the magazine, for example with a carriage or with an overhead crane or other means, in other embodiments, it would also be possible for the guide 5 to extend toward a heating area, provided with means for heating the corrugating rollers of the corrugating units installed on the magazine, before inserting them into the respective single facer.

When a magazine only serves one single facer it is still particularly advantageous, as it allows one or the other of several corrugating units to be loaded on the single facer, one corrugating unit being normally in the operating position in the single facer, while the others are located in the seats of the magazine.

In the figures subsequent to FIG. 1, the plant 1 is represented limited to one single facer 3 with respective shuttle 11 and second guide 9 for moving the shuttle 11. It must be understood that this is purely an example and that all the characteristics of the magazine, of the shuttle, of the guides, of the corrugating unit and of the single facer described in detail with reference to FIG. 2 and the following ones can be provided in a plant in which the magazine serves several single facers in line.

The structure of a plant according to the present invention will be described in greater detail below with specific reference to FIGS. 2A, 3A, 3B, 8, 9, 10, 11, 12, 13 and 14. The replacement cycle of a corrugating unit will be described later with reference to the sequence of FIGS. 2A, 2B, 2C and 3A-7B.

Figure 2A:
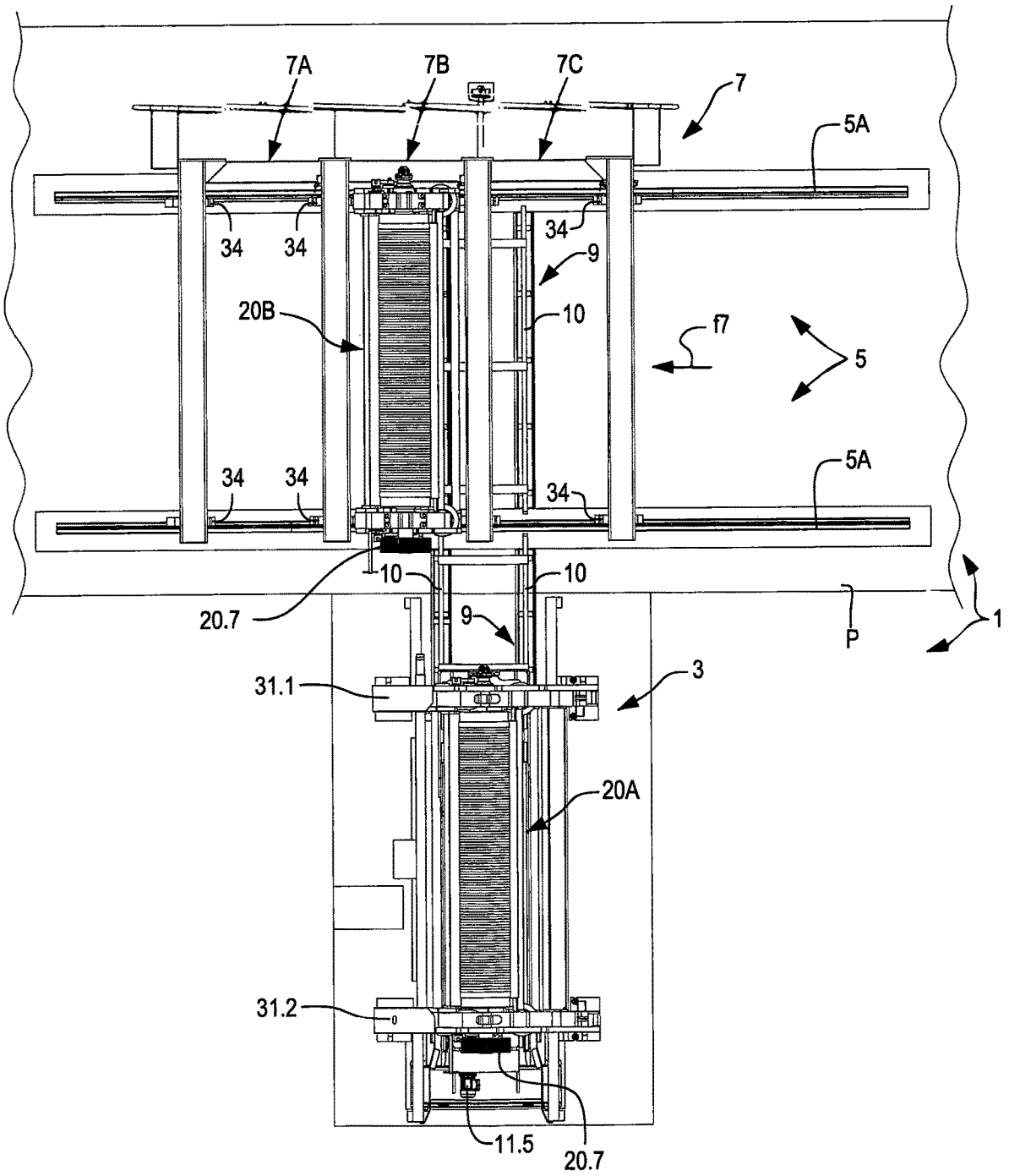
FIGS. 2A, 2B, 2C show plan views of a magazine and of a single facer in three different mutual positions.
Figure 3A:
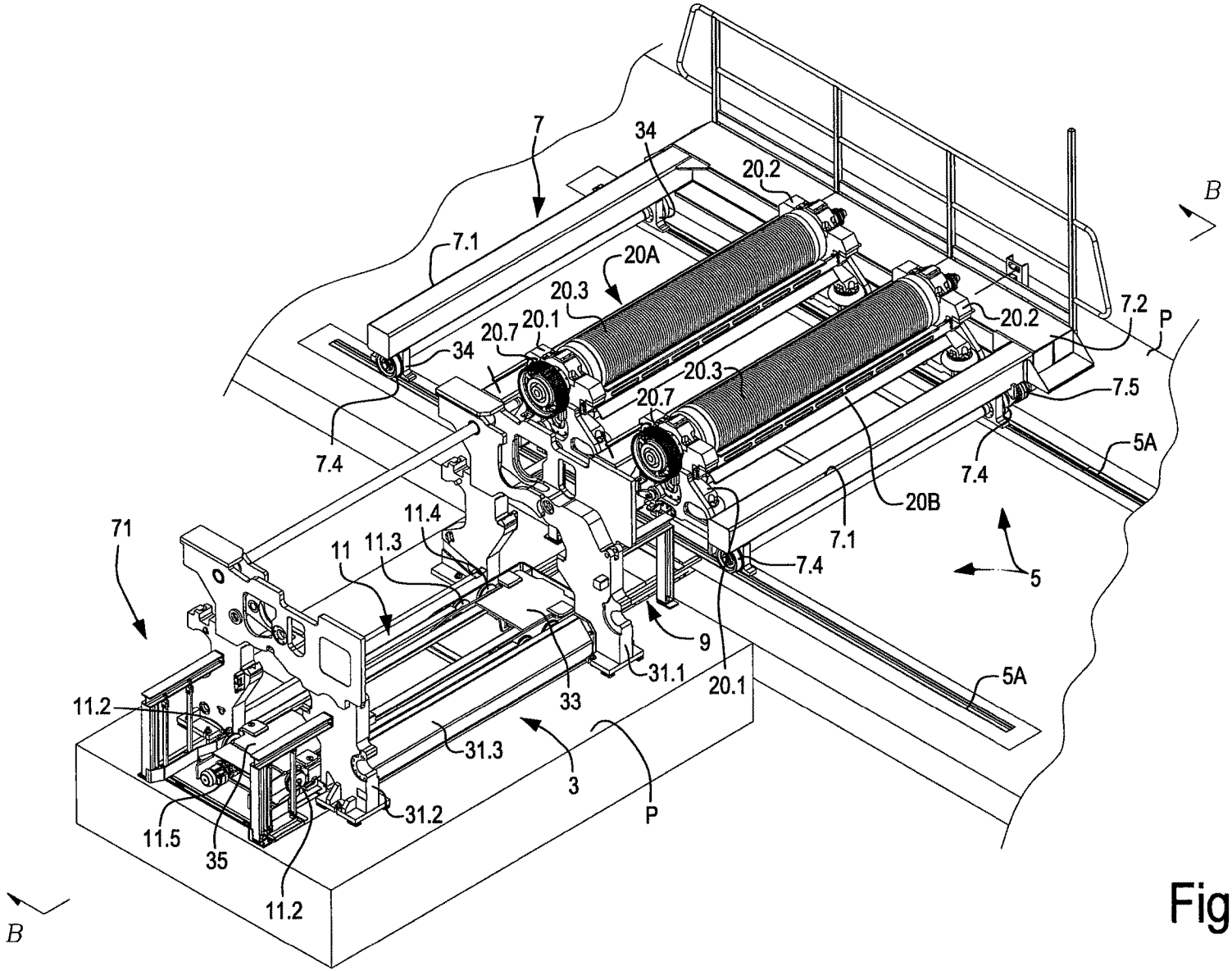
FIG. 3A shows an axonometric view of a single facer and of the magazine aligned therewith in an operating position.

The plant 1 of FIG. 2A and the following ones comprises the single facer 3, arranged at the side of which is the first guide 5, which can comprise the rails 5A. The magazine 7 moves on the guide according to the arrow f7. In the illustrated example, the magazine 7 comprises three seats 7A, 7B, 7C for three corrugating units. In the appended drawings, two corrugating units, indicated with 20A and 20B, are visible. In the arrangement of FIG. 2A, a first corrugating unit 20A is in operating position in the single facer 3, while a second corrugating unit 20B is located in one of the three seats of the magazine 7 in FIG. 3A both the corrugating units 20A, 20B are located in the magazine 7. FIG. 3A also shows some details of the magazine 7.

In particular, in the illustrated embodiment the magazine 7 comprises a structure consisting of cross members 7.1 joined to each other by a beam 7.2. The cross members 7.1 and the beam 7.2 in substance define a comb structure, inside which the shuttle 11 associated with the single facer 3 can enter. Each pair of adjacent cross members 7.1 defines a seat for a respective corrugating unit.

The magazine 7 also has wheels 7.4, arranged in pairs to run along the rails 5A. At least one pair of wheels 7.4 is motorized, for example by means of a motor 7.5 (see FIG. 3A) carried by the magazine 7.

Figure 8:
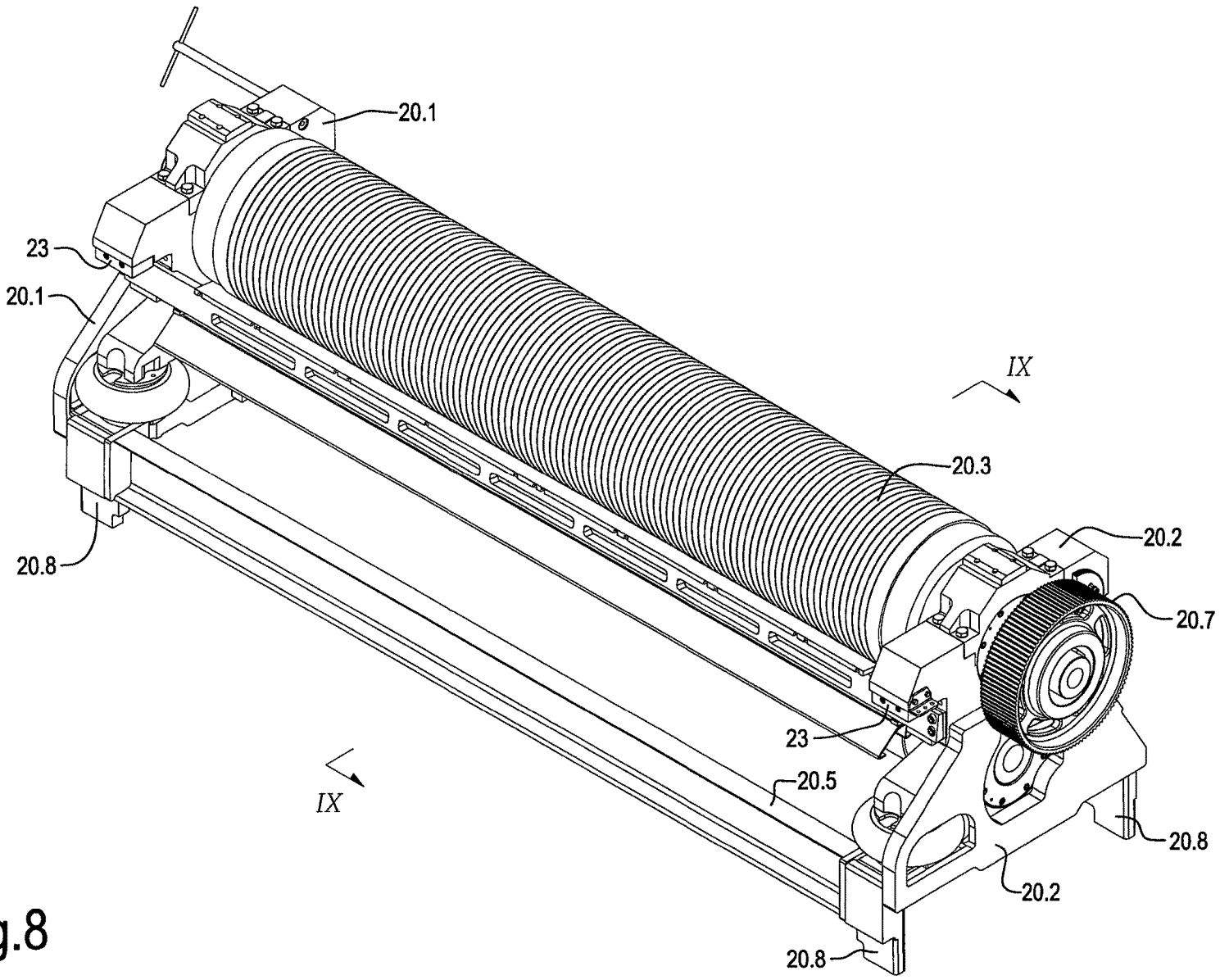
FIG. 8 shows an axonometric view of a corrugating unit.
Figure 9:
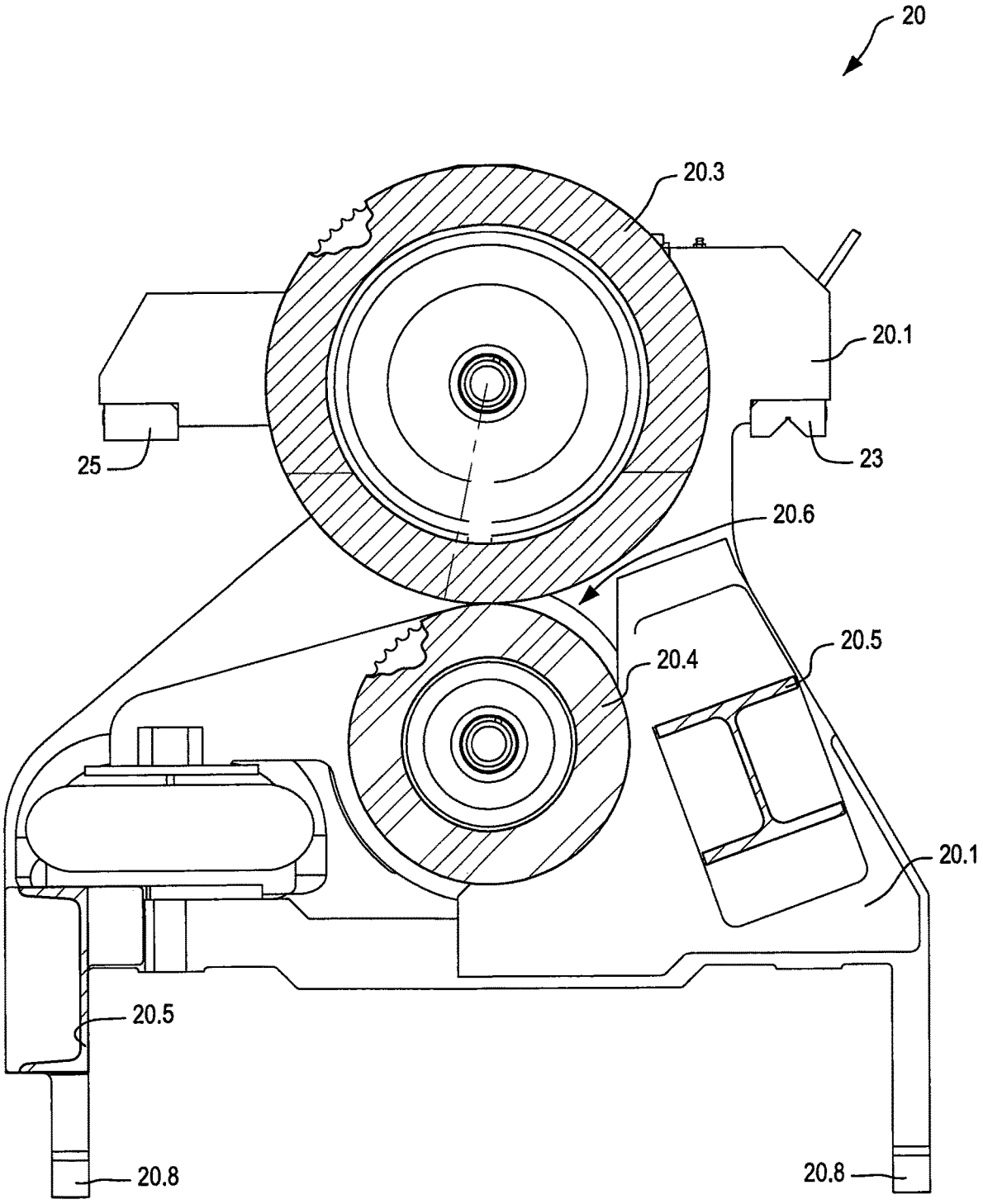
FIG. 9 show s a section in a plane orthogonal to the axis of the corrugating rollers, according to the line IX-IX of FIG. 8.

The structure of the corrugating unit 20 is generally known and only some aspects thereof useful in the present context will be described below. With reference in particular to FIGS. 8 and 9, each corrugating unit 20A, 20B, indicated with 20 in FIGS. 8 and 9, comprises two heads 20.1, 20.2, supported between which are a first corrugating roller 20.3 and a second corrugating roller 20.4 meshing with each other in a corrugating nip 20.6 (FIG. 9). The heads 20.1, 20.2 are joined to each other by beams 20.5. Reference 20.7 indicates a toothed pulley or toothed wheel that receives motion from a mover, not shown, and rotates the two corrugating rollers 20.3, 20.4 when the corrugating unit 20 is in the single facer 3.

Reference 20.8 indicates four feet for supporting the corrugating unit 20 on the floor P or on the magazine 7.

Each of the two heads are fitted with two profiles 23, 25, which define surfaces for supporting and centering the corrugating unit 20 on the single facer 3. More in particular, the two profiles 23 define a supporting surface shaped with two V-shaped notches, while the profiles 25 define flat supporting surfaces. The two profiles 23, 25 are configured to rest on complementary profiles 27, 29, integral with a supporting structure 31 of the single facer 3.

The supporting structure 31 of the single facer 3 comprises side panels 31.1, 31.2 joined by cross members 31.3. The side panel 31.1 forms a through opening 31.4, while the side panel 31.2 forms a through opening 31.5 (see in particular FIG. 10). The openings 31.4 and 31.5 allow the insertion of a corrugating unit 20 into the supporting structure 31 passing through either one or the other of the two side panels 31.1, 31.2 for the purposes that will be explained below. In other embodiments, the side panel 31.2 can be without a through opening, in which case the corrugating units 10 are inserted into and extracted from the single facer 3 only through the side panel 33.1.

Each shuttle 11 comprises a base structure 11.1, for example formed by a frame of welded beams, equipped with wheels. More in particular, the wheels of the shuttle 11 can be arranged in pairs. As shown in particular in FIG. 3B, a first pair or wheels 11.2 is advantageously motorized by means of a motor 11.5 carried by the shuttle 11, while two pairs of wheels 11.3 and 11.4 are idle and are arranged in the vicinity of the end of the shuttle opposite the end at which the motorized wheels 11.2 are located and oriented toward the magazine 7.

Advantageously, the pairs of wheels 11.3 and 11.4 are arranged with their axes close to one another so as to provide a continuous support on the rails 10, along which the shuttle 11 moves, also in the areas in which the rails 10, forming the guide 9, are interrupted to intersect one of the rails 5A of the first guide 5.

Figure 12:
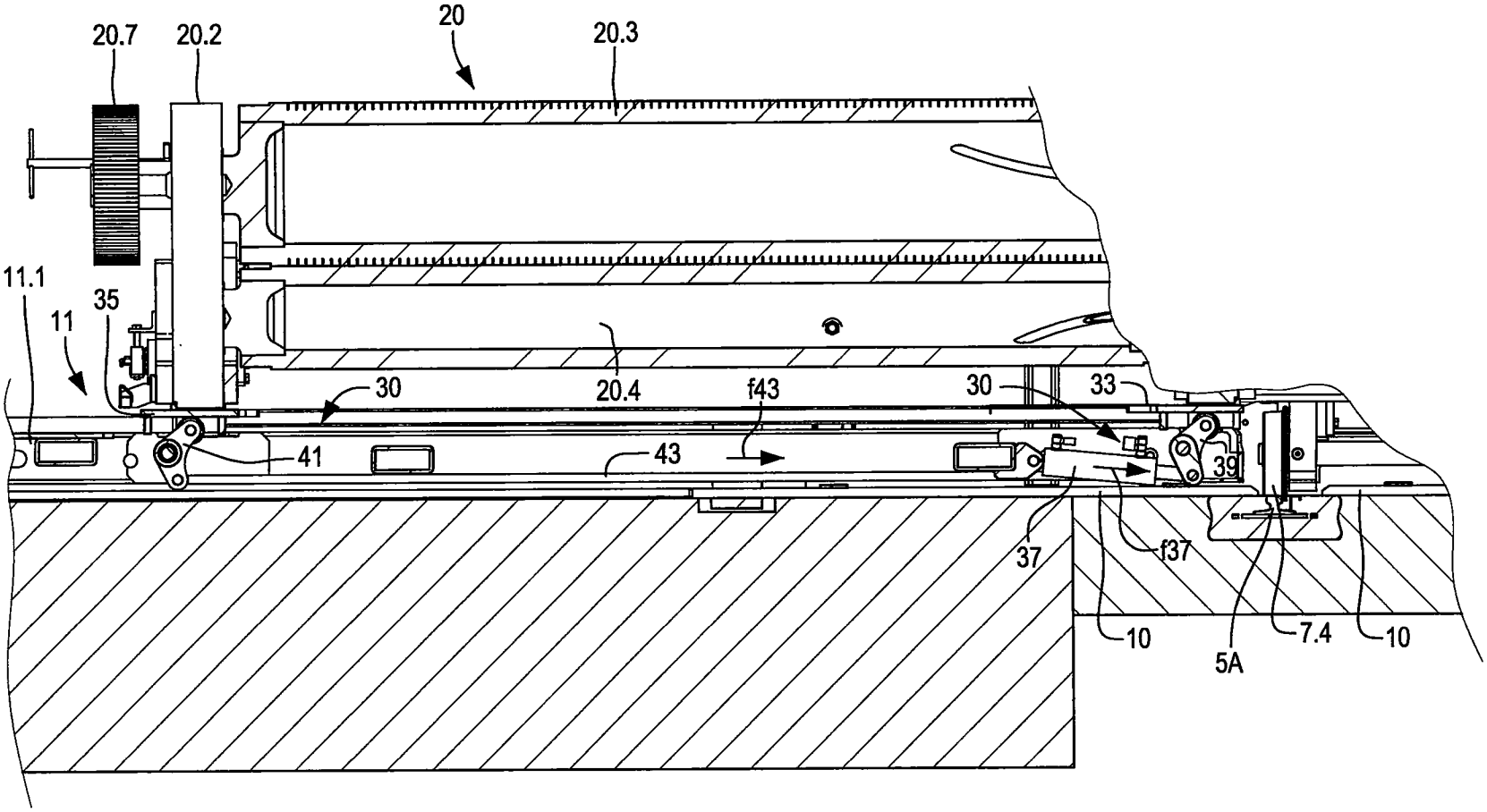
FIG. 12 shows a section according to a longitudinal plane of the shuttle with a corrugating unit.
Figure 13:
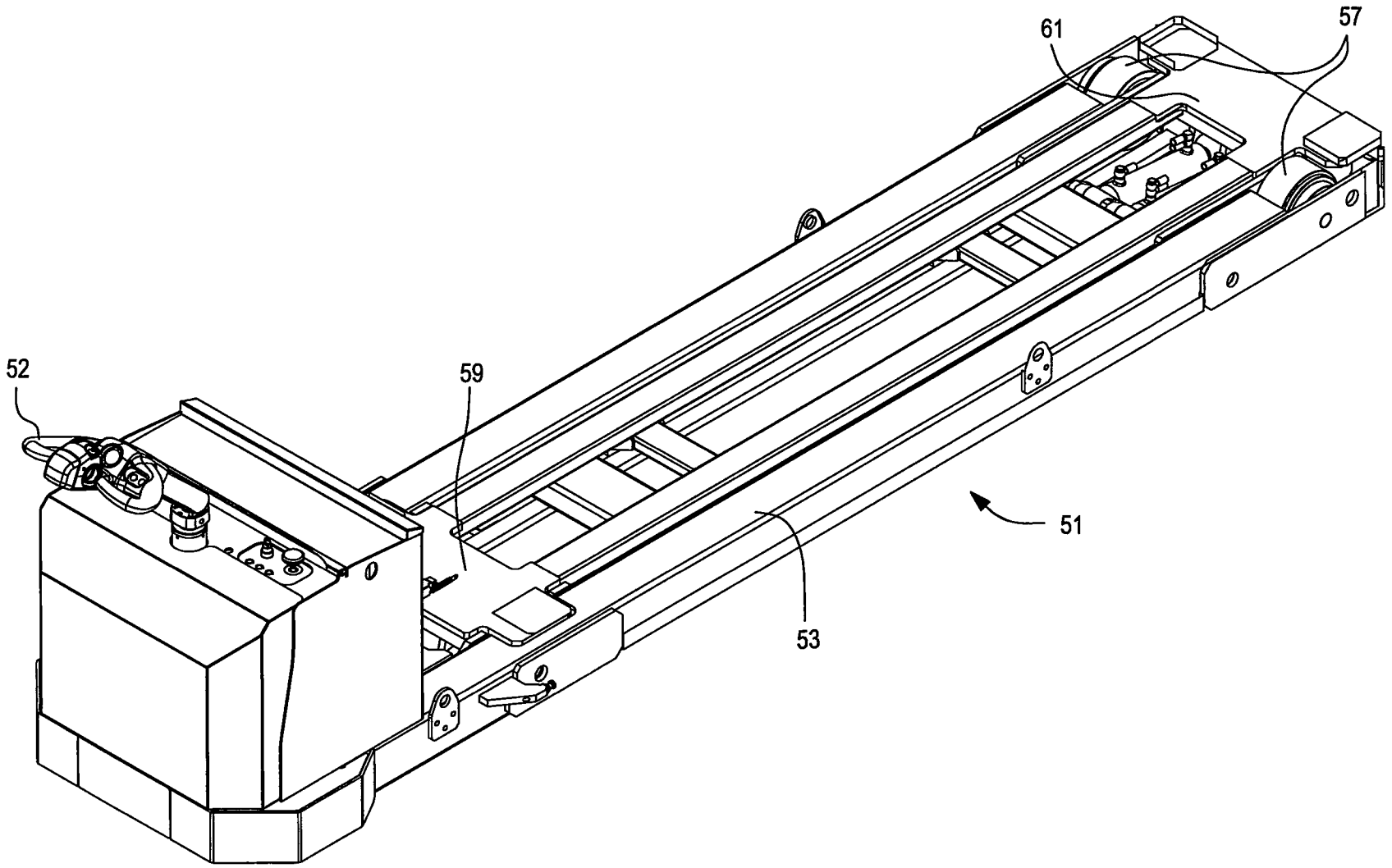
FIG. 13 shows an axonometric view of an auxiliary carriage for moving corrugating units.
Figure 14:
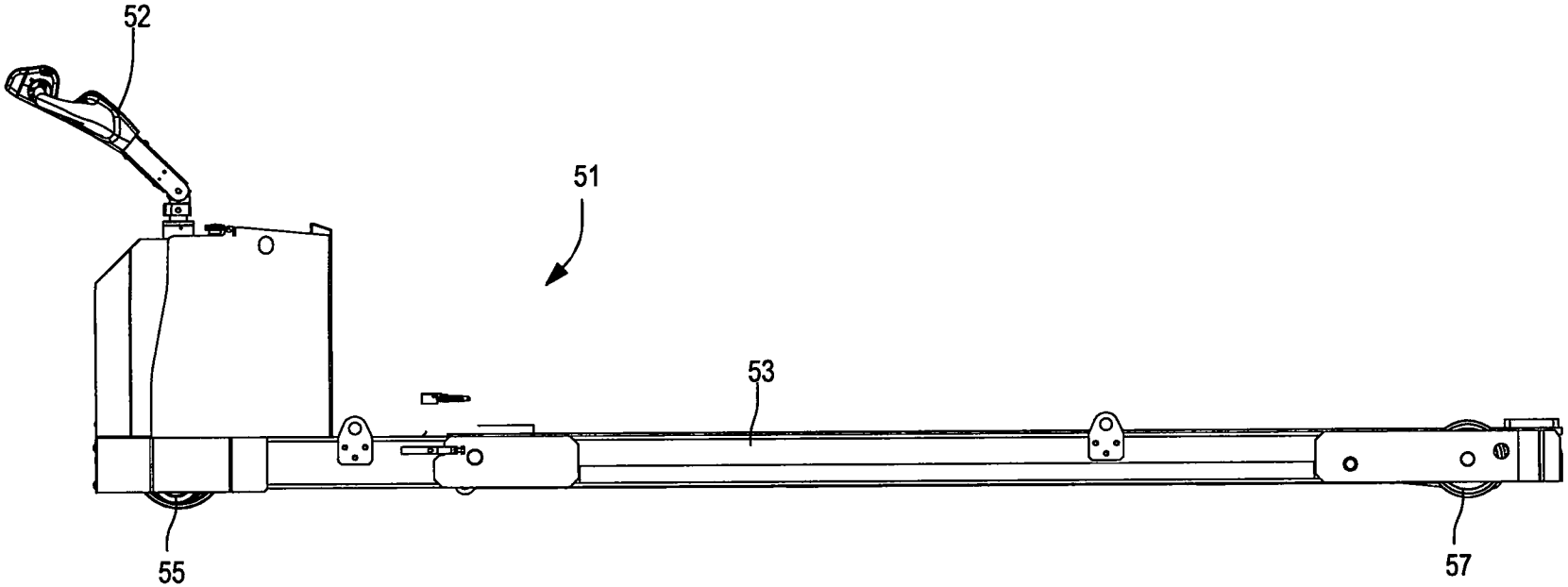
FIG. 14 shows a side view of the carriage of FIG. 13.

Advantageously, the shuttle 11 can comprise lifting members 30, shown in particular in the detail of FIG. 12. In the illustrated embodiment, the lifting members 30 comprise two supporting surfaces 33, 35 movable vertically by means of a lifting and lowering actuator 37, for example a piston-cylinder actuator. The lifting and lowering actuator 37 can act directly on a pair of levers 39 pivoted about an axis which is stationary with respect to the shuttle 11, so that the extension and contraction of the lifting and lowering actuator 37 causes a rotation movement of the levers 39 and consequent lifting and lowering of the supporting surface 33. By means of a transmission bar 43 the movement of the lifting and lowering actuator 37 can be transmitted to a second pair of levers 41, which rotate to control the lifting and lowering movement of the surface 33. The lifting mechanism is described purely by way of example. Any other lifting mechanism can be used, for example also using different power sources, such as pneumatic or electric mechanisms.

The supporting surfaces 33, 35 form supports for the corrugating unit 20. Said supporting surfaces 33, 35 can coact with the heads 20.1, 20.2 of each corrugating unit 20. By means of these supporting surfaces, it is possible to lift a corrugating unit 20 from the supporting structure 31 of the single facer 3 or rest a corrugating unit 20 on this supporting structure 31. By means of the aforesaid supporting surfaces it is also possible to deposit a corrugating unit 20 on the magazine 7, or lift it from the magazine 7. The lifting and lowering movement with which the shuttle 11 is provided can also be used to rest the corrugating units 20 on, or lift them from, the floor P.

Figure 2B:
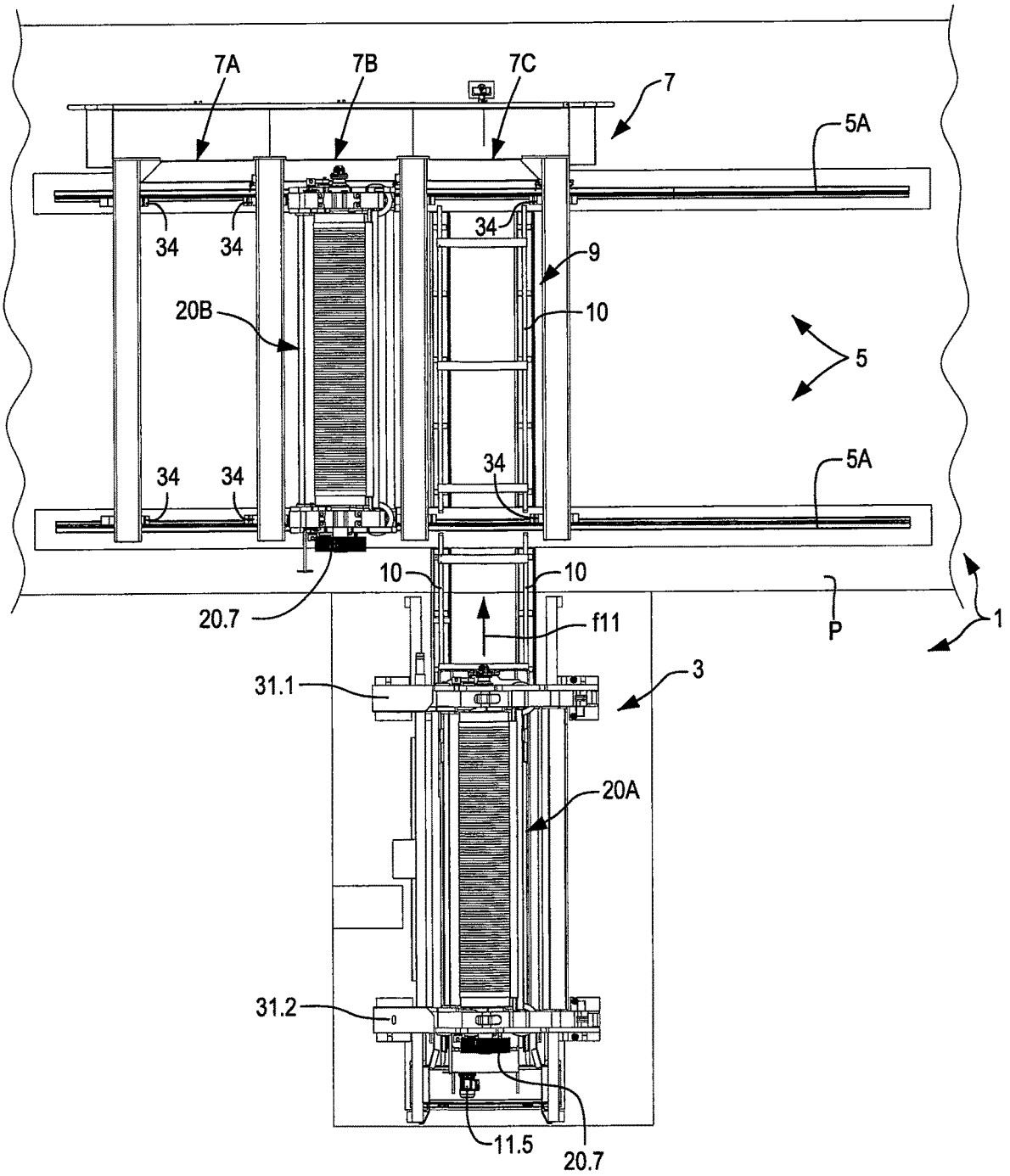
Figure 2C:
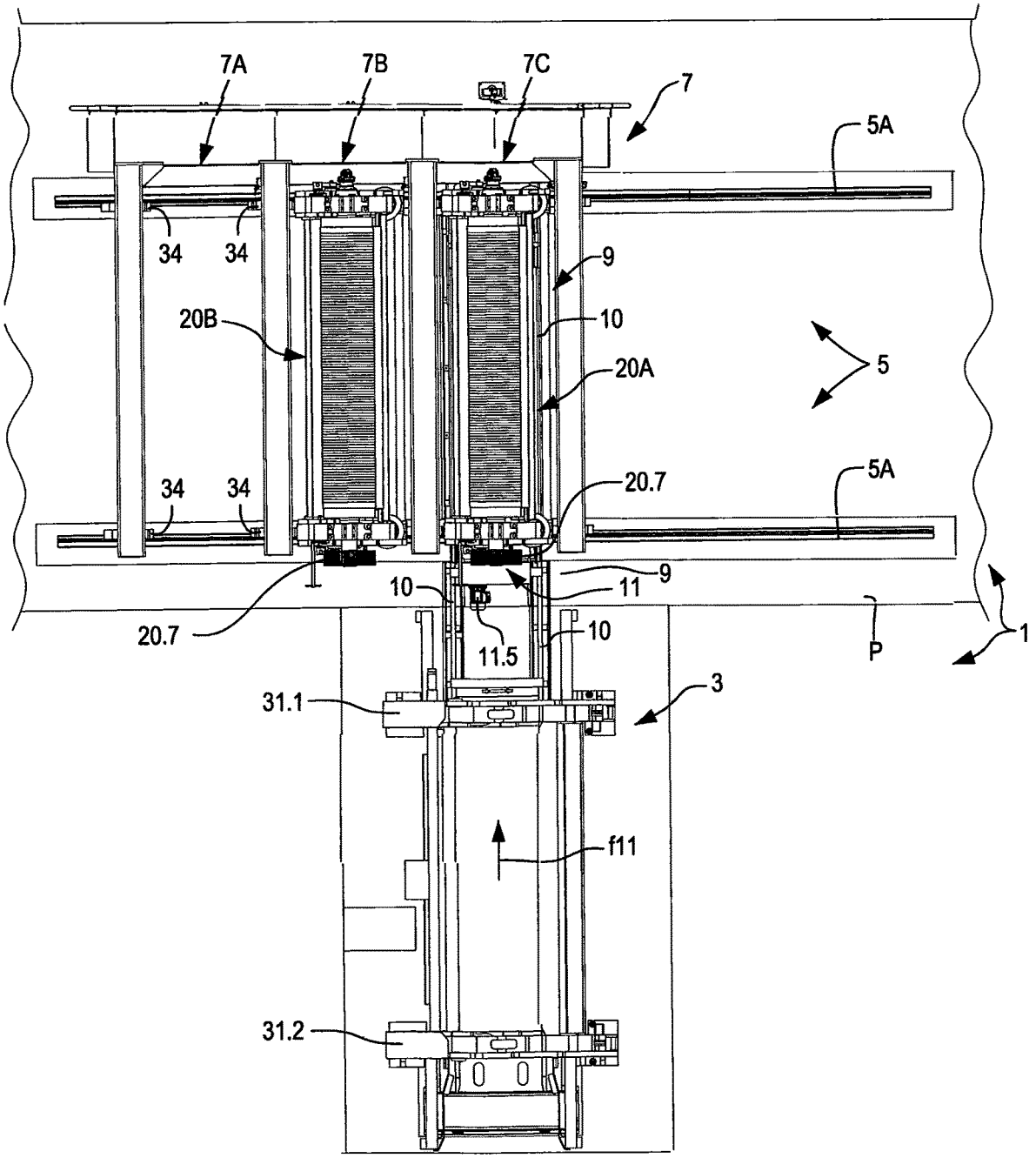

FIGS. 2A, 2B, 2C show, in a plan view, the movement that can be carried out by the magazine 7 and by the shuttle 11 in order to replace the corrugating unit 20A, which is located in the single facer 3, with the corrugating unit 208 located on the magazine 7. More in particular, in this exemplary embodiment the magazine 7 has three seats 7A, 7B, 7C for three corrugating units 20. The seat 7A is empty, the seat 7B is occupied by the corrugating unit 20B and the seat 7C is empty. In FIG. 2A the magazine 7 is translating according to the arrow f7 from right to left, so as to carry the seat 7C into alignment with the openings of the side panels 31.1, 31.2 of the corrugating unit 20A located in the single facer 3. The shuttle 11 is located in the single facer 3, under the corrugating unit 20A.

In FIG. 2B the magazine 7 is located with its seat 7C aligned with the single facer 3. The shuttle 11 and the corrugating unit 20A are still located in the single facer 3.

In FIG. 2C the shuttle 11 has transferred the corrugating unit 20B toward the magazine 7 according to the arrow f11. To carry out this operation, as mentioned above, the corrugating unit 20A is lifted by means of the lifting and lowering actuator 37 (FIG. 12), which causes lifting of the supporting surfaces 33, 35. In this way, the corrugating unit 20A is lifted and moved away from the shaped profiles 27, 29 and can be transferred from the shuttle 11 to the magazine 7. When the shuttle 11 is located under the magazine 7, the lifting and lowering actuator 37 lowers the supporting surfaces 33, 35, releasing the corrugating unit 20B onto the seat 7C of the magazine 7. At each seat 7A, 7B, 7C of the magazine 7, suitable supporting elements can be provided, onto which the respective corrugating unit 20 can be released. In the embodiment illustrated in the accompanying drawings, the supporting elements are indicated with 34 and are configured and arranged to receive the feet 20.8 of the respective corrugating unit 20. The configuration is such that the lifting movement can be very limited, for example of only a few centimeters. This makes the replacement operations faster and safer.

From the position of FIG. 2C, the magazine 7 can translate from left to right to align the seat 7B with the openings 31.4, 31.5 of the side panels 31.1, 31.2 so as to carry out, again by means of the shuttle 11 and with operations in reverse order to those described above, insertion of the corrugating unit 20B into the single facer 3.

FIGS. 3A, 3B, 4A, 4B, 5A, 5B, 6A, 6B and 7A, 7B show, in an axonometric view (FIGS. 3A, 4A, 5A, 6A, 7A) and in a sectional view according to the lines B-B (FIGS. 3B, 4B, 5B, 6B, 7B) by way of example a transfer cycle of a corrugating unit (in the illustrated example the corrugating unit 20A) from the magazine 7 to the single facer 3. The sequence is self-explanatory and will only be described briefly. The operations are carried out by means of the shuttle 11 equipped with the lifting members 30.

Figure 3B:
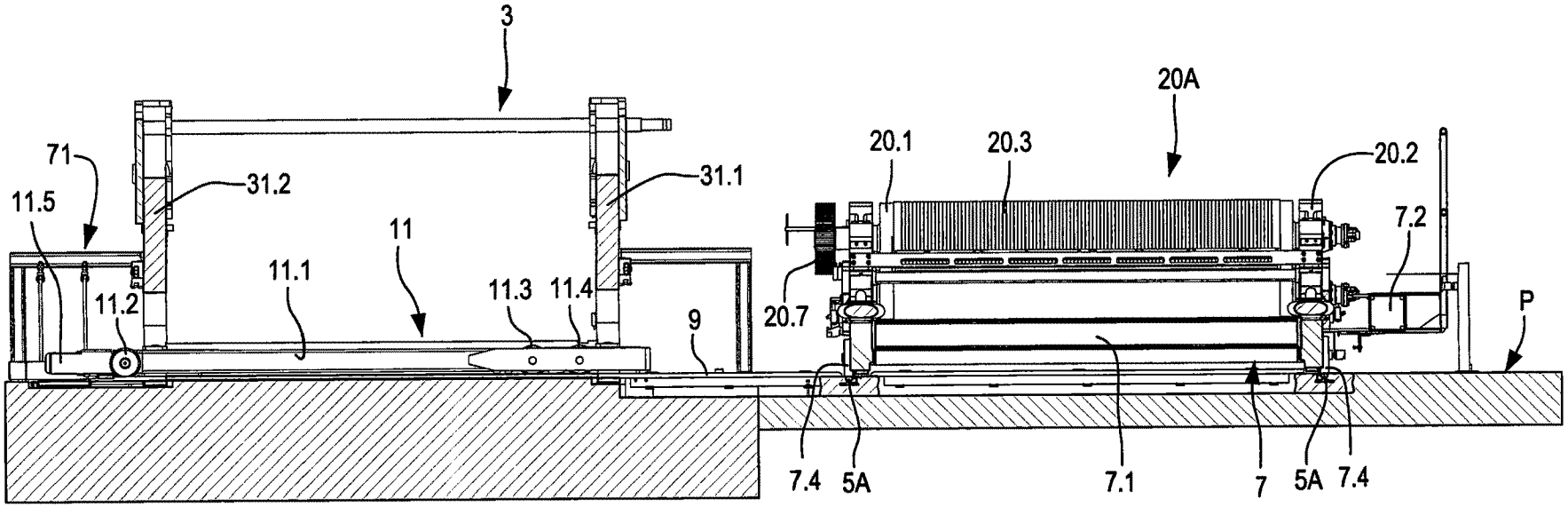
FIG. 3B shows a view according to B-B of FIG. 3A.
Figure 4A:
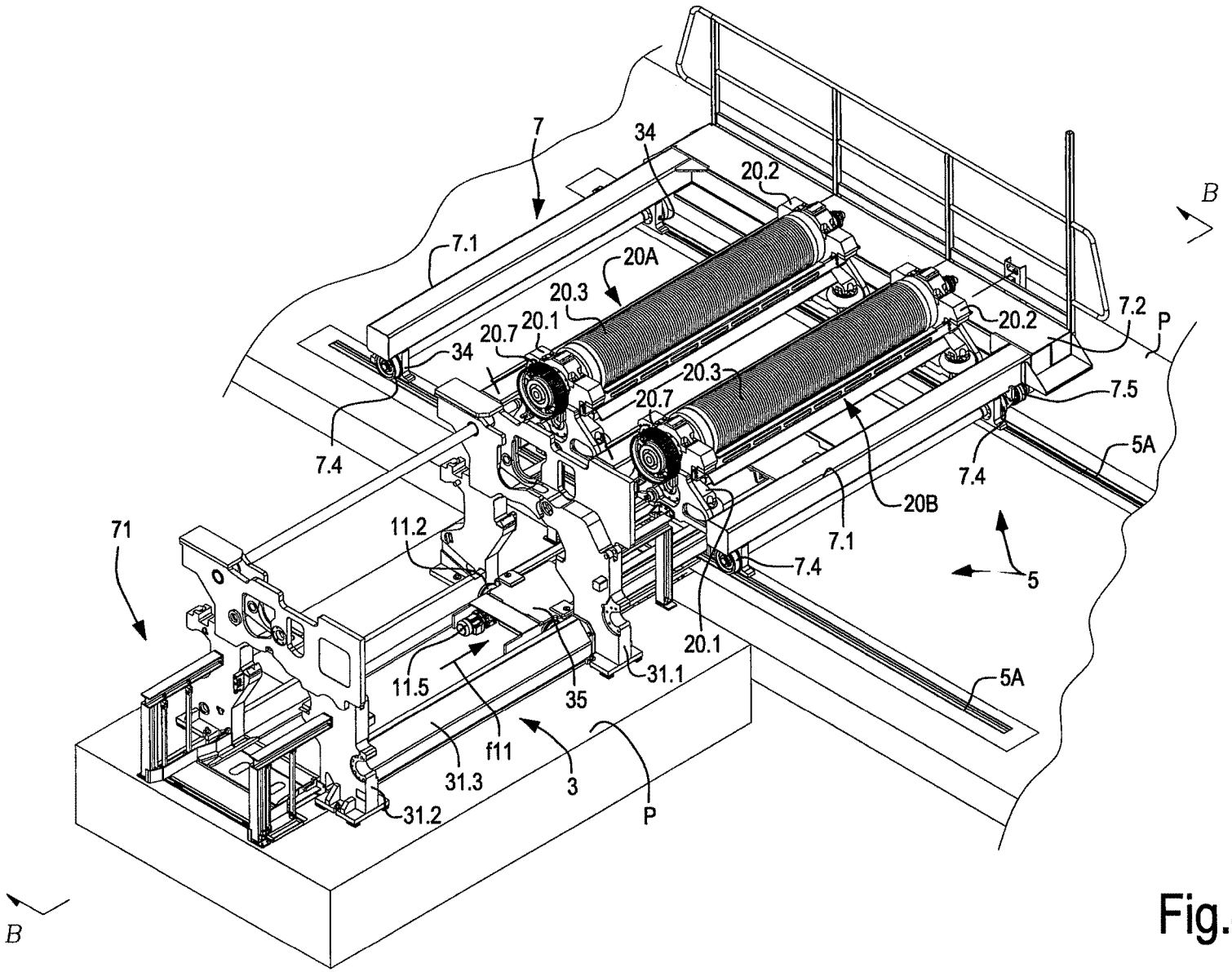
FIG. 4A shows an axonometric view analogous to FIG. 3A in a subsequent step of a cycle to replace a corrugating unit.
Figure 4B:
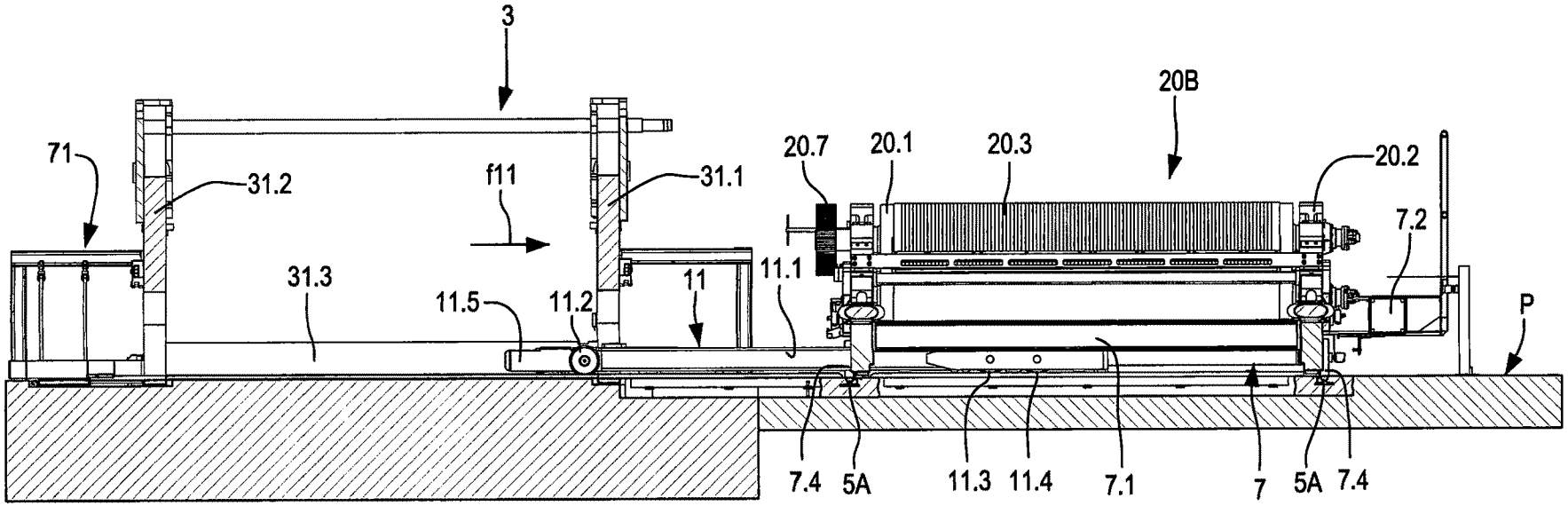
FIG. 4B shows a view according to B-B of FIG. 4A.
Figure 5A:
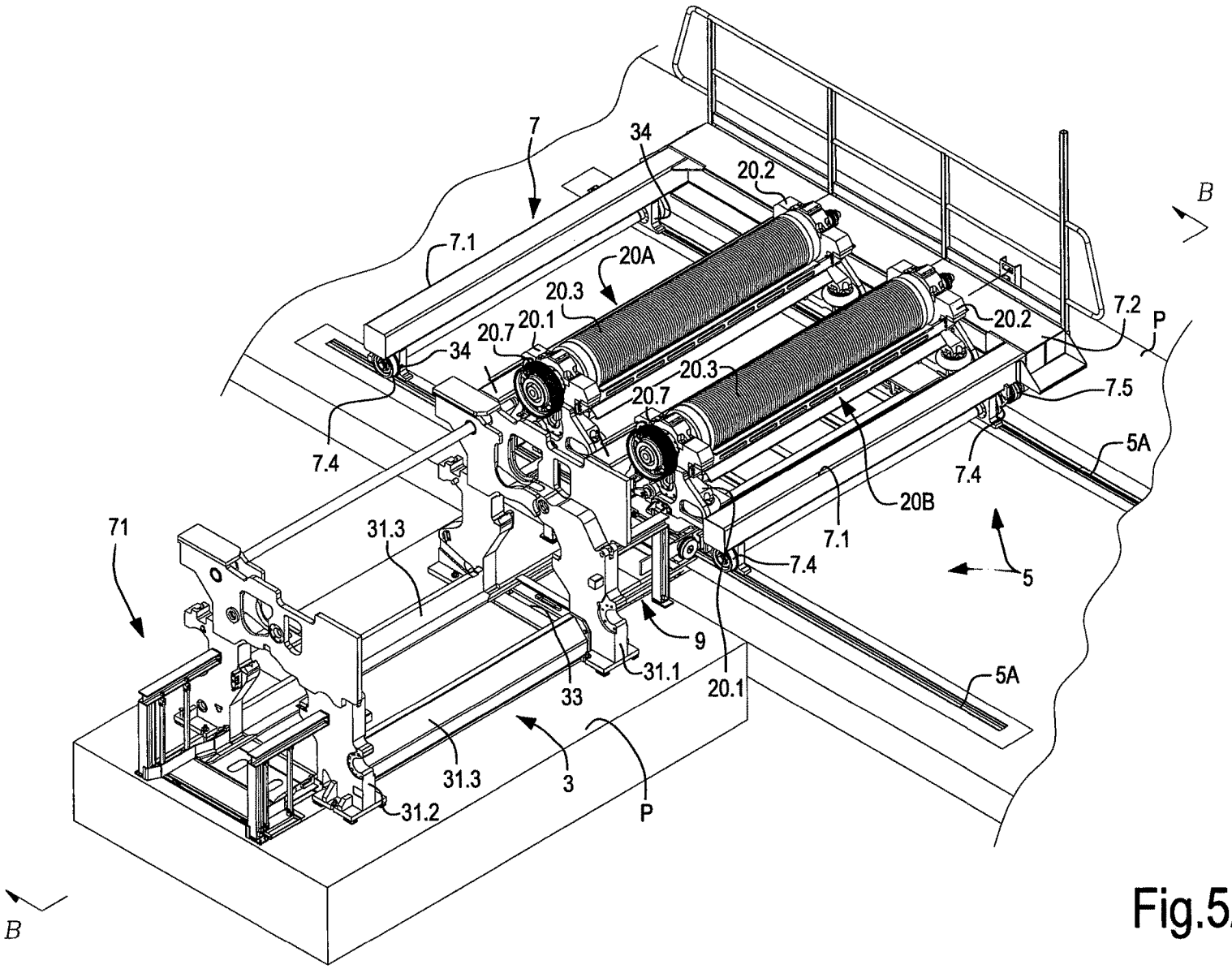
FIG. 5A shows an axonometric view analogous to FIGS. 3A, 4A, in a subsequent step of the cycle to replace the corrugating unit.
Figure 5B:
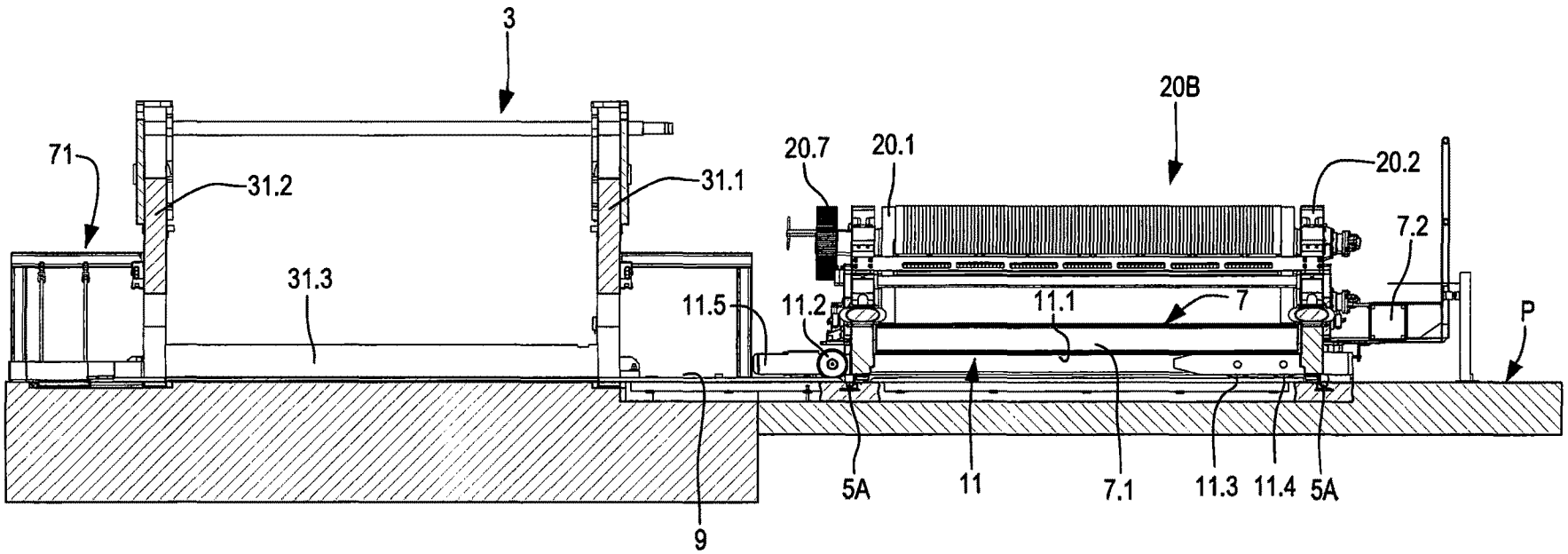
FIG. 5B shows a view according to B-B of FIG. 5A.
Figure 6A:
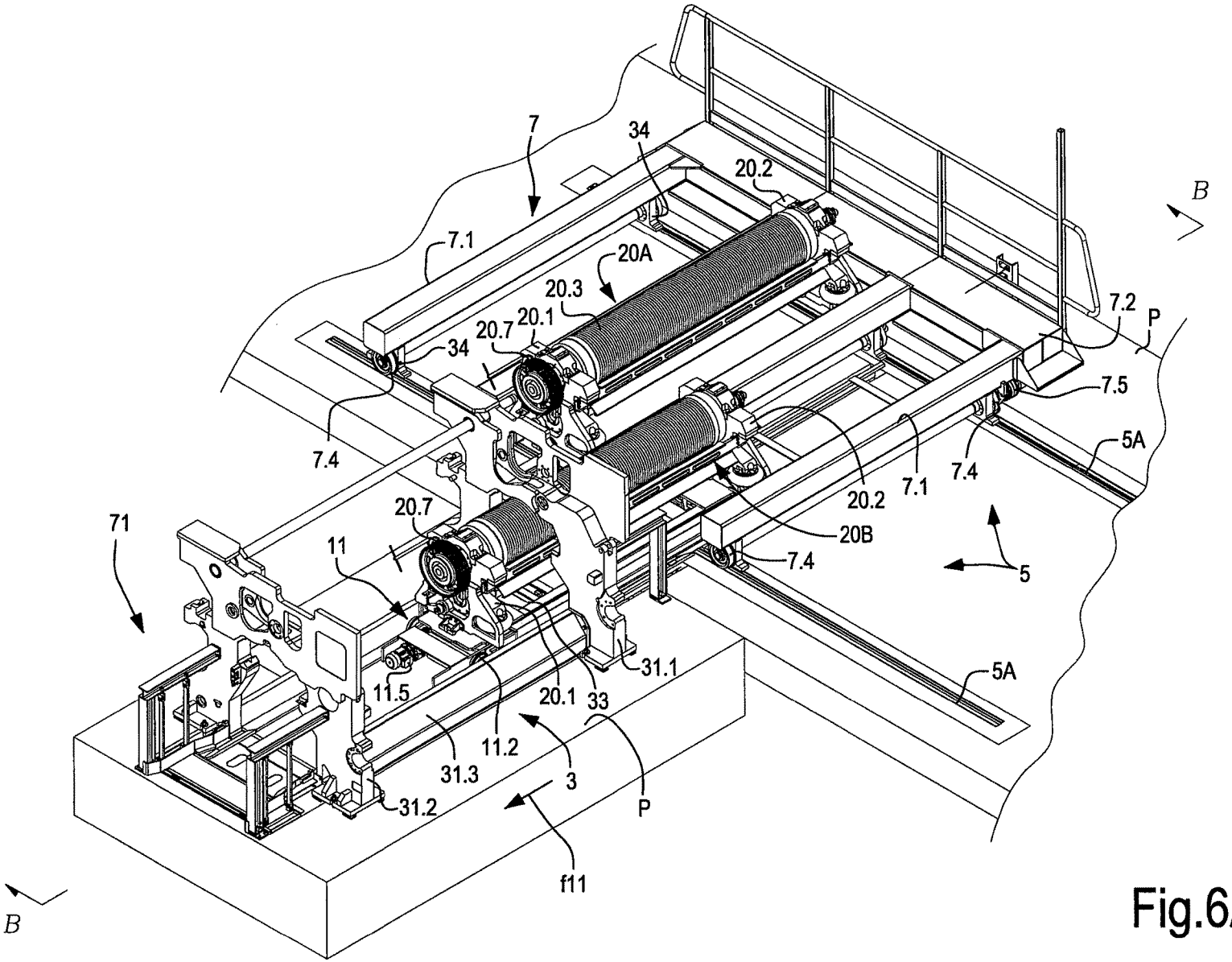
FIG. 6A shows an axonometric view analogous to FIGS. 3A, 4A, 5A in a subsequent step of the cycle to replace the corrugating unit.
Figure 6B:
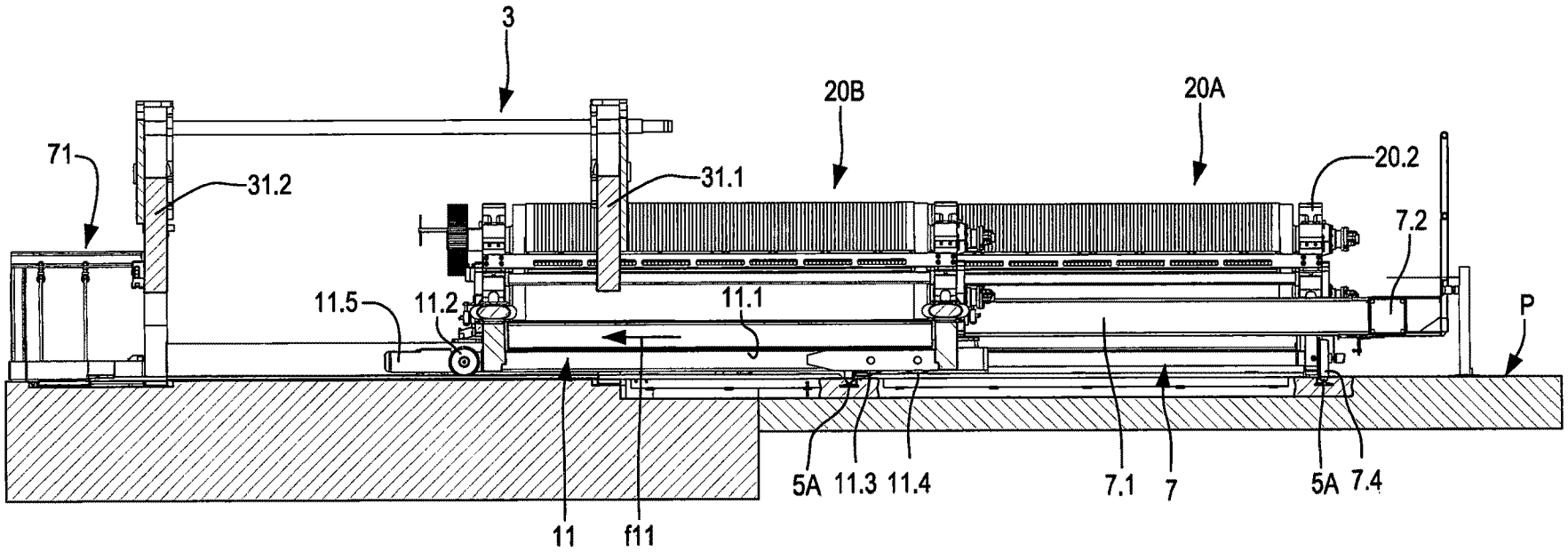
FIG. 6B shows a view according to B-B of FIG. 6A.
Figure 7A:
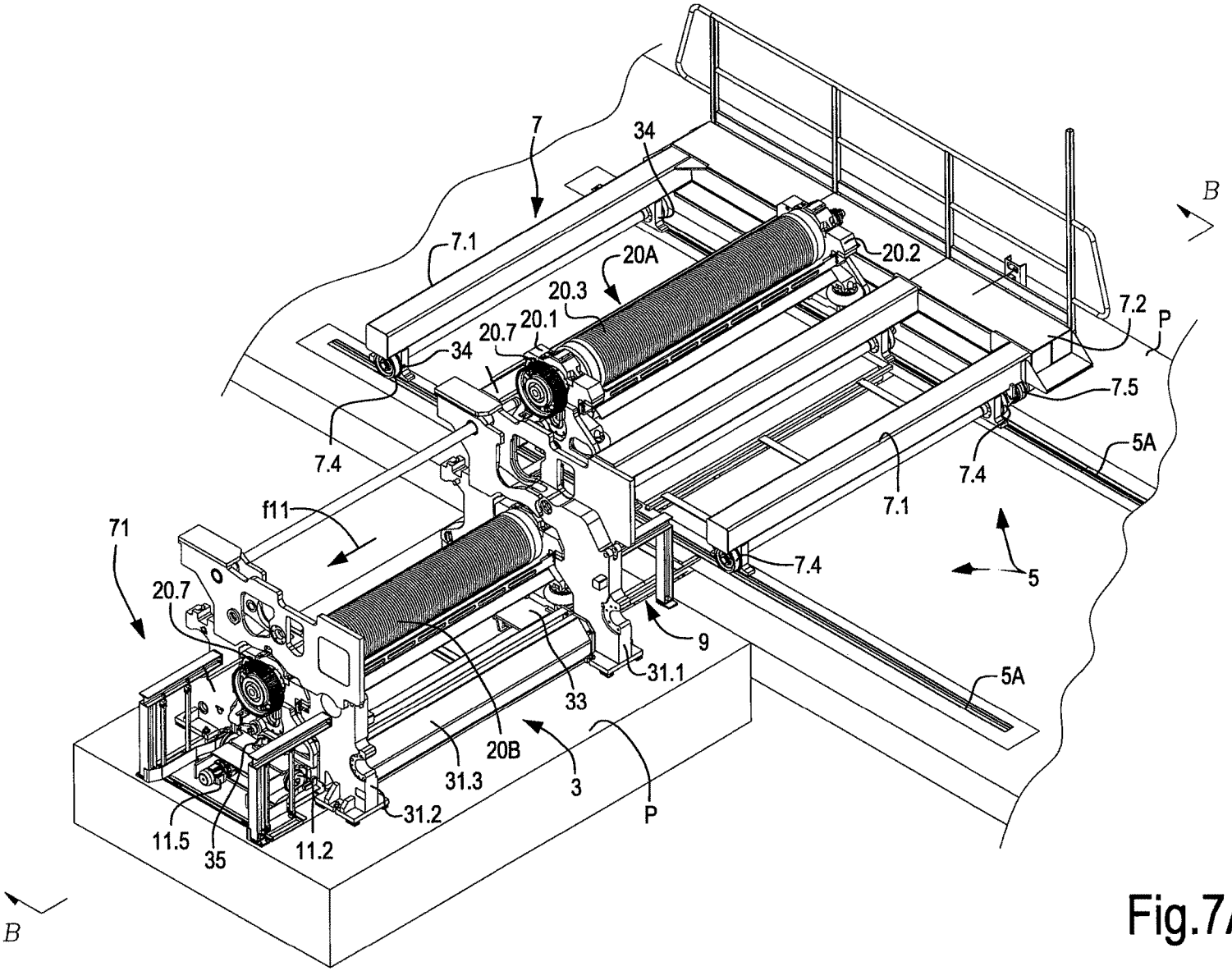
FIG. 7A shows an axonometric view analogous to FIGS. 3A, 4A, 5A, 6A, in a subsequent step of the cycle to replace the corrugating unit.
Figure 7B:
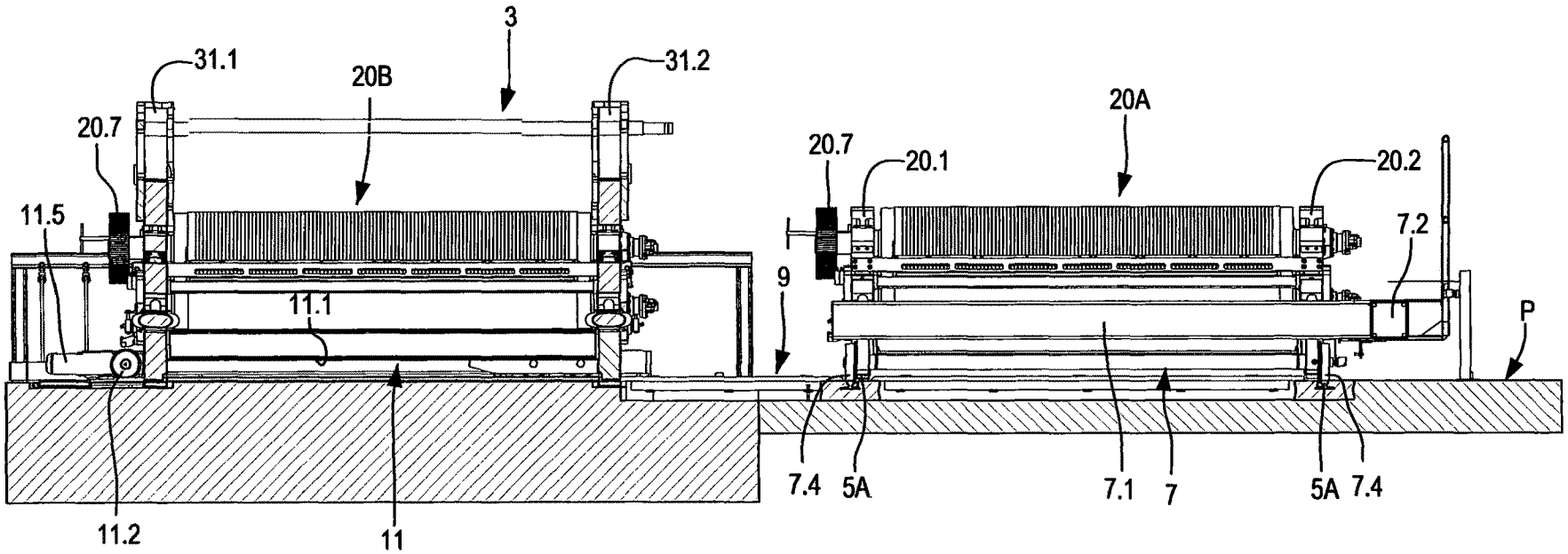
FIG. 7B shows a view according to B-B of FIG. 7A.

In FIGS. 3A, 3B the seat 7C of the magazine 7 is aligned with the single facer 3. The shuttle 11 is located in the single facer 3, to allow positioning of the magazine 7. In FIGS. 4A, 4B the shuttle 11 is being transferred (arrow f11) under the magazine 7. In FIGS. 5A, 5B the shuttle 11 is under the corrugating unit 20A. In FIGS. 6A, 6B the shuttle 11 is transferring (arrow f11) the corrugating unit 20A into the single facer 3. Before starting the movement towards the single facer, the lifting members 30 have lifted the corrugating unit 20A from the supports 34 of the seat 7C of the magazine 7. In FIGS. 7A, 7B the shuttle 11 with the corrugating unit 20A is inserted into the single facer 3, between the two side panels 31.1, 31.2 thereof and the corrugating unit 20A can be lowered and taken to rest on the side panels 31.1, 31.2.

As mentioned, the side panel 31.2 is open to allow insertion of a corrugating unit 20 therethrough from the side opposite to the magazine 7. For this purpose, an auxiliary carriage 51, shown in FIGS. 13 and 14, can be used. The auxiliary carriage 51 can have a steering and control handlebar 52. Reference 53 indicates a frame of the auxiliary carriage 51. Reference 55 indicates a rear driving wheel, pivoting about a vertical axis. The motor of the wheel 55 is not shown. Reference 57 indicates idle wheels arranged on the front part of the auxiliary carriage 51. The wheels 55, 57 can be partially rubber coated, to allow the free movement of the auxiliary carriage 51 on the floor or ground surface P. A part, with a smaller diameter, of the wheels 55, 57 can be made of steel to coact with the rails 10A, 10B of the shuffle 11.

The auxiliary carriage can advantageously comprise auxiliary lifting members 59, 61, which can be configured as the previously described lifting members 30 or in any other suitable way. The lifting members 30 can comprise vertically movable surfaces that lift and lower a corrugating unit 20 with respect to the floor P and/or with respect to the supporting structure 31 of the single facer. For this purpose, the lifting members 30 are placed at a suitable height to be able to release the corrugating unit 20 on the ground, resting thereon by means of the respective supporting feet 20.8.

The auxiliary carriage 51 can be used both for inserting a corrugating unit 20 into the single facer 3 and for extracting it therefrom, and for loading, a corrugating unit onto the magazine 7 or removing it therefrom. The auxiliary carriage can also be used to move the corrugating units 20 to any part of the plant, as said auxiliary carriage can move freely rather than on guides. In this way the plant 1 becomes very flexible and allows easy movement of even a very large number of corrugating units 20.

Figure 10:
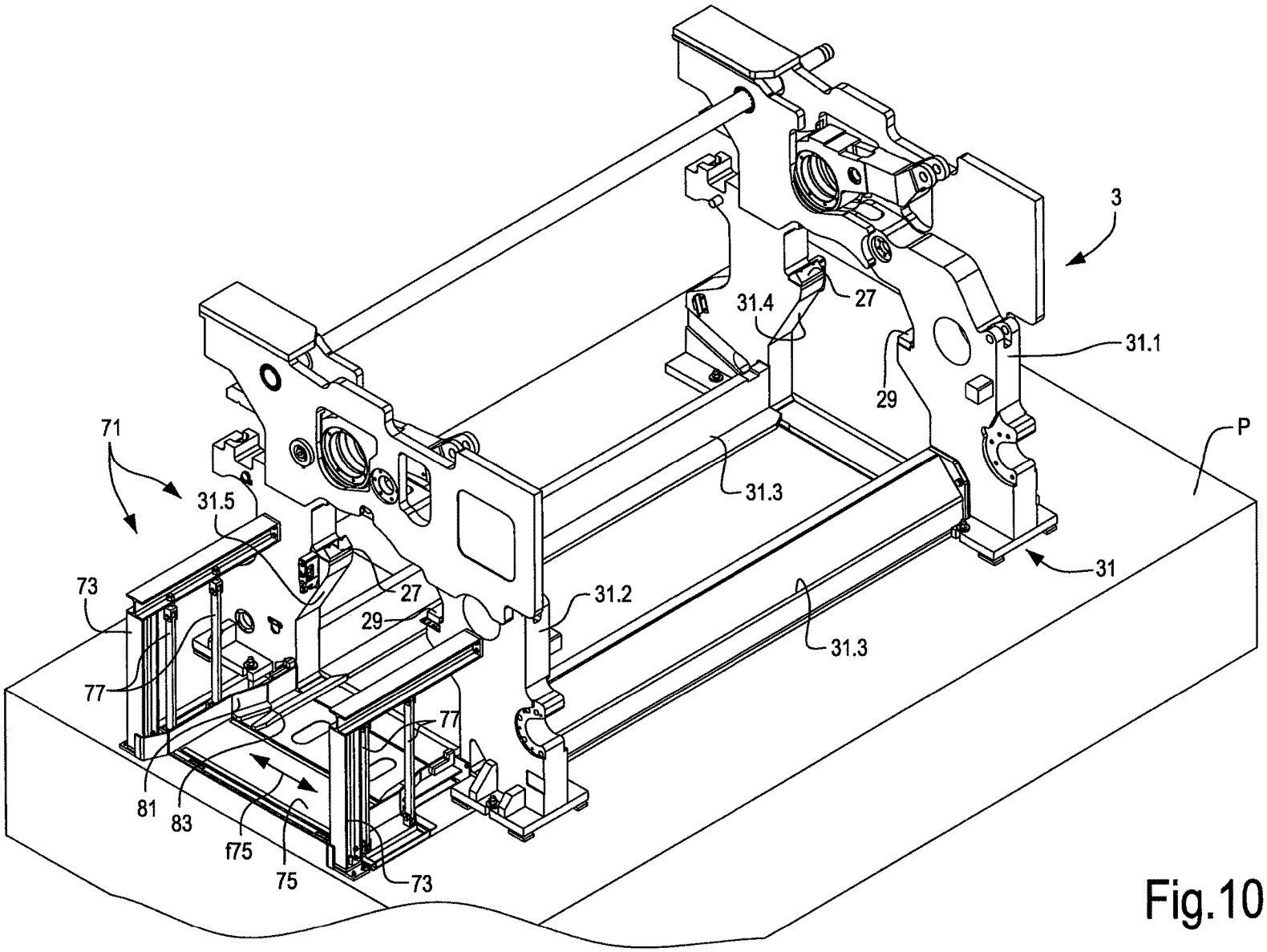
FIG. 10 shows an axonometric view of the supporting structure of a single facer.

To facilitate insertion of the auxiliary carriage 51 into the single facer 3 through the side panel 31.2, an aligning device 71 can be provided, described below with particular reference to FIGS. 10 and 11. The aligning device 71 is positioned at the side of the single facer 3 outside the side panel 31.2. The aligning device 71 can comprise a frame structure 73 integral with the supporting structure 31 of the single facer 3. A platform 75 is hung from the frame structure 73, approximately flush with the floor P and movable according to the double arrow f75 transversely to a direction of alignment of the auxiliary carriage 51 with respect to the supporting structure 31 of the single facer 3. The direction of alignment is substantially parallel to the direction of the axes of the corrugating rollers 20.3, 20.4 when the respective corrugating unit 20 is correctly inserted into the single facer 3.

Figure 11:
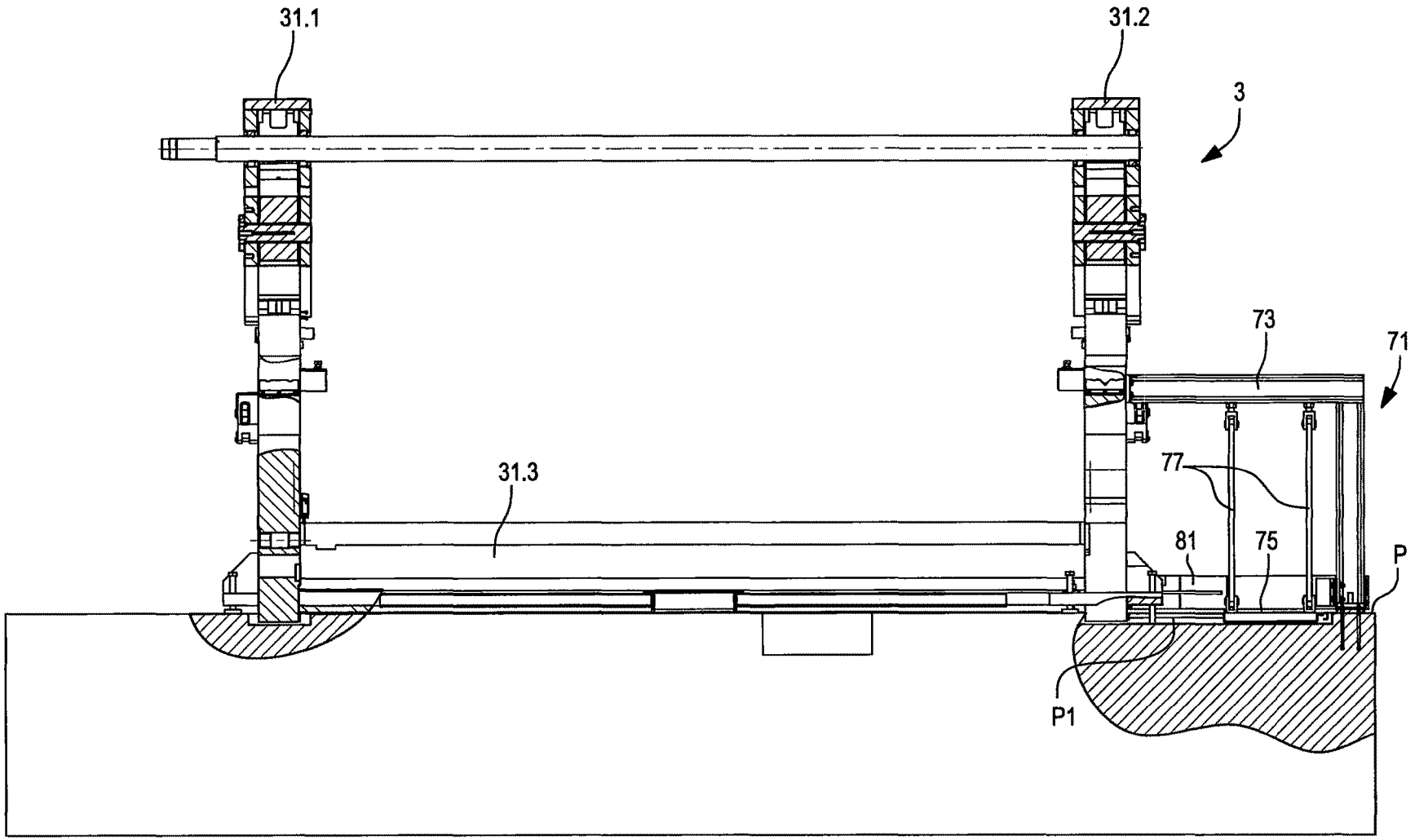
FIG. 11 shows a section according to a vertical plane parallel to the axes of the corrugating rollers, according to the line XI-XI of FIG. 10.

Advantageously, the platform 75 has a small thickness so as to be able to be placed approximately flush with the floor P without requiring to dig a hole to house it, but if necessary lowering the floor only slightly at P1 (FIG. 11).

In the illustrated embodiment, to allow the platform 75 to float with respect to the floor P according to the arrow f75, the platform 75 is hung by means of tie rods 77 from the frame structure 73. In this way, no guide members of the platform 75 are required to be housed in the floor P and there is no need for excavations. In substance, the platform 75 is hung on the frame structure 73 in the manner of a pendulum by means of the tie rods 77. The swinging movement of the platform 75 is limited to a few degrees and therefore the platform remains substantially parallel to the floor P during the oscillating motion.

A fixed guide 81 is associated with the platform 75, integral with the floor P and adapted to generate a thrust on the auxiliary carriage 51 in a direction transverse to a direction of approach and insertion of the auxiliary carriage into the single facer 3, i.e., a thrust with a component parallel to the movement f75 of the platform 75 with respect to the floor P. The fixed guide 81 can have two side members opposite each other and converging from the outside toward the side panel 31.2 of the supporting structure 31. Downstream of the converging side members forming the fixed guide 81 are rails 83 on which the front wheels 57 of the auxiliary carriage 51 can be mounted. The rails 83 can form an extension of the rails on which the shuttle 11 runs.

With this arrangement, insertion of a corrugating unit 20 with a manual operation using the auxiliary carriage 51 is particularly easy, notwithstanding the weight of a few tons of the corrugating unit 20. In fact, even if the auxiliary carriage 51 moves laterally toward the single facer 3 with a direction of movement not perfectly parallel to the direction that the axes of the corrugating rollers 20.3, 20.4 must assume after being inserted into the single facer 3, the impact of the front part of the carriage 51 against the side members 81 of the alignment guide corrects the trajectory of the auxiliary carriage 51, due to the fact that the lateral thrust exerted by the side members 81 on the auxiliary carriage 51, while it is resting with the front wheels 57 on the floating platform 75, causes a translation movement according to the arrow 175 of the platform and therefore of the front part of the carriage, until obtaining the correct alignment.

The above described embodiment of the corrugated board manufacturing plant 1 allows many advantages to be obtained. The presence of a shuttle 11 for moving the corrugating units 20 away from and toward the magazine 7 allows said magazine and the related guide 5 to be positioned even at a considerable distance from the corrugated board line, i.e., far from the single facers 3. In fact, there are substantially no limits to the distance that can be traveled by the shuttles 11. If the guides 10 are flush with the floor or ground level P, they practically cause no obstacle to the movement of people or vehicles.

Using lifting members in the shuttle 11, it is possible to provide the corrugating units 20 with a structure suitable to be positioned in the operating position by lowering them onto the supporting profiles 27, 29. It is possible to omit the actuators normally required in the single facers of the prior art, to maintain the corrugating units raised against reference stops positioned in the upper area. This simplifies the machine and greatly increases its reliability. The corrugating unit can be maintained blocked in the correct operating position simply by its weight and if required with the aid of the pressure exerted thereon by a roller or other pressure member that, in a known manner, applies the gluing pressure on the corrugating roller 20.3.

Using a shuttle 11 with its own handling means of the corrugating units 20, in particular with lifting members 30, it is no longer necessary to provide guides on the magazine and moving members inside the single facer 3. This last aspect is particularly useful considering that severe environmental conditions exist inside the single facer, in particular due to the high temperatures, which can lead to rapid deterioration of the moving members.

What is claimed is:

1. A plant for producing corrugated board, comprising:

at least one single facer, comprising a supporting structure, adapted to receive a corrugating unit comprising a first corrugating roller and a second corrugating roller meshing with each other;

a magazine comprising a plurality of seats for receiving corrugating units and movable along a first guide; associated with each of the at least one single facer is a shuttle movable between the single facer and the first guide of the magazine, adapted to transfer the corrugating units from the at least one single facer to the magazine and vice versa; wherein the shuttle comprises lifting members, adapted to lift the corrugating unit from the supporting structure of the single facer and from the magazine and to lower the corrugating units onto the supporting structure of the single facer and onto the magazine, whereby corrugating units can be lifted by the shuttle from the supporting structure of the single facer, transferred by the shuttle to the magazine and released by the shuttle on the magazine, and vice-versa.

2. The plant of claim 1, wherein the shuttle is adapted to pick up the corrugating unit positioned in one of said plurality of seats aligned with the single facer, transferring said corrugating unit into the single facer and releasing the corrugating unit in the single facer; and pick up the corrugating unit positioned in the single facer, transferring the corrugating unit into the magazine and releasing the corrugating unit in the magazine.

3. The plant of claim 1, wherein the first guide is substantially orthogonal to the first corrugating roller and the second corrugating roller of the corrugating unit when said corrugating unit is housed in the single facer.

4. The plant of claim 1, wherein the first guide is approximately at a level of a floor on which the single facer is installed.

5. The plant of claim 1, wherein the shuttle is movable along a second guide extending between the single facer and the first guide.

6. The plant of claim 5, wherein the second guide is parallel to axes of the first corrugating roller and the second corrugating roller of a corrugating unit when said corrugating unit is in the single facer.

7. The plant of claim 5, wherein the first guide and the second guide intersect each other.

8. The plant of claim 7, wherein the second guide is interrupted at rails forming the first guide.

9. The plant of claim 5, wherein the first guide and the second guide are orthogonal to each other.

10. The plant of claim 1, wherein the shuttle comprises three pairs of wheels for resting on and moving along a respective second guide, a first pair of the three pairs of wheels in a vicinity of a first end of the shuttle, a second pair and a third pair of the three pairs of wheels being adjacent to each other and in a vicinity of a second end of the shuttle, the second end of the shuttle facing the first guide.

11. The plant of claim 1, further comprising a plurality of the at least one single facer arranged in sequence along a direction of alignment, said direction of alignment being parallel to the first guide; wherein each single facer of the plurality of the at least one single facer comprises a respective shuttle movable between said each single facer and the first guide, the shuttle adapted to transfer the corrugating units from a respective single facer to the magazine and vice versa; and wherein the magazine is adapted to position itself selectively in alignment with one or another of the plurality of said at least one single facer to allow transfer, by a respective one of the shuttle, of corrugating units from the magazine to a respective single facer and vice versa.

12. The plant of claim 11, wherein with each one of the plurality of the at least one single facer, there is associated a respective second guide, along which the respective shuttle is movable, each of said second guides extending from the respective one of the at least one single facer toward the first guide.

13. The plant of claim 1, wherein the magazine comprises a motor on the magazine, which controls movement of the magazine along the first guide.

14. The plant of claim 1, wherein the shuttle comprises a motor on the shuttle, which controls movement of the shuttle.

15. The plant of claim 1, further comprising an auxiliary, carriage, freely movable on a floor, comprising supports for corrugating units and lifting and lowering members of the corrugating units.

16. The plant of claim 15, wherein the single facer is associated with an aligning device adapted to align the auxiliary carriage and facilitate insertion of the auxiliary carriage into the single facer.

17. The plant of claim 16, wherein said aligning device comprises a platform approximately flush with the floor and movable transversely to a direction of alignment of the auxiliary carriage with respect to the supporting structure of the single facer; and a fixed guide adapted to generate a thrust on the auxiliary carriage in a direction transverse to a direction of approach and insertion of the auxiliary carriage into the single facer.

18. The plant of claim 17, wherein said platform and said fixed guide are positioned on one side of the single facer opposite the first guide.

19. The plant of claim 17, wherein the platform is suspended by tie rods and is floating approximately parallel to the floor.

20. A method for inserting a corrugating unit into a single facer, the corrugating unit comprising a first corrugating roller and a second corrugating roller meshing with each other; the method comprising steps of:

positioning a magazine comprising a plurality of seats for corrugating units, so that one of said seats is aligned with the single facer;

with a shuttle movable from the single facer to the magazine and vice versa and performing at least one of the following steps:

a) picking up a corrugating unit positioned in said seat aligned with the single facer and transferring said corrugating unit into the single facer; or b) picking up a corrugating unit positioned in the single facer and transferring said corrugating unit into the magazine;

wherein the corrugating unit is picked up from the single facer or from the magazine by lifting members carried by the shuttle and configured to lift the corrugating unit from the seat of the magazine and from a supporting structure of the single facer and to lower the corrugating unit onto the seat of the magazine and onto the supporting structure of the single facer.

21. A plant for producing corrugated board, comprising:

a single facer, comprising a supporting structure, adapted to receive a corrugating unit comprising a first corrugating roller and a second corrugating roller meshing with each other;

a magazine comprising a plurality of seats for receiving corrugating units and movable along a first guide;

associated with the single facer, a shuttle adapted to move into the single facer under a corrugating unit supported on the supporting structure of the single facer and movable from the single facer to the magazine to transfer the corrugating units from the single facer to the magazine and vice versa; and wherein the shuttle is adapted to move under the corrugating unit supported in one of said plurality of seats and engage the corrugating unit, and to move the corrugating unit from the seat of the magazine into the single facer.

22. A method for replacing a corrugating unit in a single facer, the corrugating unit comprising a first corrugating roller and a second corrugating roller meshing with each other; the method comprising steps of:

positioning a magazine comprising a plurality of seats for corrugating units, so that one of said plurality of seats is aligned with the single facer;

providing a shuttle movable from the single facer to the magazine and vice versa;

introducing the shuttle in the single facer under a first corrugating unit positioned on a supporting structure of the single facer;

transferring the first corrugating unit to the shuttle;

moving the shuttle with the first corrugating unit engaged therewith from the single facer into the magazine;

releasing the first corrugating unit from the shuttle on a first one of said plurality of seats of the magazine;

placing the shuttle under a second corrugating unit placed on a second one of said plurality of seats of the magazine;

engaging the second corrugating unit to the shuttle; moving the shuttle with the second corrugating unit engaged therewith from the magazine into the single facer;

transferring the second corrugating unit to the supporting structure of the single facer.

* * * * *